US006426454B1

(12) United States Patent
Gregory

(10) Patent No.: US 6,426,454 B1
(45) Date of Patent: Jul. 30, 2002

(54) STRINGED MUSICAL INSTRUMENTS AND METHOD THEREFOR

(76) Inventor: Maestro Alex Gregory, 6032 Colfax Ave., North Hollywood, CA (US) 91606

( * ) Notice: Subject to any disclaimer, the term of this patent is extended or adjusted under 35 U.S.C. 154(b) by 0 days.

(21) Appl. No.: 09/511,878

(22) Filed: Feb. 25, 2000

(51) Int. Cl.[7] ..... G10D 1/08

(52) U.S. Cl. ..... 84/267; 84/312 R; 84/293; 84/294

(58) Field of Search ..... 84/312 R, 293, 84/294, 267, 298, 304, 297 S

(56) References Cited

U.S. PATENT DOCUMENTS

| | | | | | |
|---|---|---|---|---|---|
| 3,868,880 | A | * | 3/1975 | Chapman | 84/267 |
| 4,004,482 | A | * | 1/1977 | Yates | 84/455 |
| 4,470,334 | A | * | 9/1984 | Barlow | 84/1.28 |
| 4,911,055 | A | * | 3/1990 | Cipriani | 84/299 |
| 5,519,165 | A | * | 5/1996 | Gregory | 84/293 |
| 5,700,965 | A | * | 12/1997 | Gregory | 84/297 R |
| 5,717,150 | A | * | 2/1998 | Rose | 84/297 S |
| 5,945,615 | A | * | 8/1999 | Rose | 84/297 S |

OTHER PUBLICATIONS

Grove's Dictionary of Music and Musicans , Eric Bloom, 1954, Macmillan & Co., vol. VI, pp. 267, 269.*

The New Grove Dictionary of Musical Instruments, Stanley Sadie, 1997, Macmillan Publishers Limted, vol. II, pp. 834–835.*

* cited by examiner

*Primary Examiner*—Robert E. Nappi
*Assistant Examiner*—Kim Lockett
(74) *Attorney, Agent, or Firm*—Cislo & Thomas LLP

(57) ABSTRACT

A musical system for stringed instruments based on tuning in fifths in conjunction with component control reduces dissonance and discord while increasing harmony and consonance. In a stringed instrument, the main music-making portion of the string serves to drive the other non-music-making portions or supporting portions of the string. This is particularly true at the end of the string past the stop point toward the fixed end and upward past the nut towards the turnable post controlled by a key. By appropriately selecting and providing adjustment for the stop point, as well as the length of the strings past the bridge, less dissonance arises from the individual string as it is played. A string retainer or the like, as well as a compound head, may serve to provide adjustable or selectable means by which tension on a plurality of strings may be adjusted to provide uniform tension between individual strings. Tuning in fifths provides inter-string harmony. According to the available range of individual instruments, an entire orchestra including stringed instruments, tuned drums, and vocalists achieve an ensemble known as the PENTA orchestra, an ensemble incorporating the PENTA system of the present invention.

20 Claims, 12 Drawing Sheets

STRINGED MUSICAL INSTRUMENTS AND METHOD THEREFOR

BACKGROUND OF THE INVENTION

1. Field of the Invention

This invention relates to musical instruments and the like, and more particularly to a system of tuning musical instruments so that they are more harmonious with themselves and the other instruments of an ensemble.

2. Description of the Related Art

Musical instruments of a variety of types and sizes have been known throughout the ages. The work *Science and Music*, written by Sir James Jeans in 1937, sets forth a number of analytical inspections of music according to scientific theory.

Woodwinds, percussion instruments, and stringed instruments generally are used to make up the present-day symphony orchestra. However, the generation or creation of music through the use of electronic instruments has developed rapidly since Les Paul made the first electric guitar.

While such instruments, and the music created by them, enjoy great popularity, the amplification of the sounds generated by the plucking of the string and the pick up of its vibrations electronically have given rise to noticeable dissonance and harmonic discontinuities. Such dissonance generally arises from two sources. In stringed instruments, a plucked string drives other adjacent strings (at their natural frequencies). Also, the plucking, strumming, or driving of the major music-making section of the string drives the other portions of the plucked string. Additionally, such other collateral areas of the unplucked strings may also be driven by a plucked string.

The nature of stringed instruments (such as a guitar, mandolin, violin, or cello) is such that there is a main portion of the string that is played in order to elicit the musical tone. For a stringed instrument which is not subject to amplification, the note is then played into the sound box and then transmitted outwardly for the enjoyment of the audience. The same is similarly true for electronically amplified instruments such as electric guitars. However, instead of there being a sound box, the note is amplified electronically for playback through speakers or the like.

In both instances, the strings are generally held in tension by keys working against a fixed end of the string. Bridges or the like are used to isolate the main music-making portion of the string from other areas of the string. In an electric guitar, the position of the bridge may define a short segment of string between the fixed end of the string and an intonation point, between the intonation point and the nut, and between the nut and the key. As can be seen, there may be at least three, and maybe more, stringed segments that are subject to vibration.

The energy used to drive the main music-making portion of the string will necessarily be transmitted to all other parts of the string. Such transmission may be diminished, and most of the energy concentrated on or in the main music-making portion of the string; nevertheless, there will be some energy transmitted to the other string segments causing them to vibrate and to transmit tones at their natural frequency. If these collateral string segments are not in tune with the main string segment, natural dissonances will arise that are easily picked up by the powerful electronic amplification techniques currently in use today.

Additionally, the plucked string will generate overtones at intervals of the main and natural frequencies. These overtones, as well as the main tone, may serve to drive the other unplucked strings of the stringed instrument. The resonation of these other, unplucked strings will be detected by the magnetic pick-ups. While these vibrations of the unplucked strings could be damped, such damping is an inconvenient exercise and, in light of the present invention, may be unnecessary.

Dissonances present in unplucked strings driven by the tone of a plucked string generally arise from the tuning conventions established by history for stringed instruments. Generally, instruments like guitars, are tuned in fourths. Such tuning of consecutive strings in fourths serves to create overtones as well as "clashy," inharmonious tones derived from or driven by the initial tone or overtones of the plucked or otherwise driven string.

With such intrinsic dissonance and inharmonious sympathetic vibrations, much more noise is generated in the production of music than is necessary. Consequently, it is a significant advance in the art to provide means by which such dissonance and lack of harmony may be remedied and replaced by consonance and harmony.

SUMMARY OF THE INVENTION

The present invention provides a system of instruments, each of which are generally tuned in fifths, in order to provide intrinsic harmony with respect to the other, main music-making portions of the instruments. Particularly, the present invention is directed toward string instruments and the sympathetic driving of the other strings on the instrument by the plucking or driving of an initial string.

Additionally, each of the strings is integrally harmonious with itself in that all aspects of the string from its fixed end to the tuning key are designed and constructed to as to provide consonance and harmony with the main music-making portion of the string. Such means include the use of the adjustable intonation points near the bridge position of the string, as well as a tension-adjusting bridge near the tuning key end of the string.

Due to the break with tradition that the present system realizes, new vocabulary and tuning schemes are established, including the use of 415.3 being the A note, as previously chosen by both Beethoven and Paganini. Currently, 440 is used for the A note.

OBJECTS OF THE INVENTION

It is an object of the present invention to provide more harmonious music.

It is yet another object of the present invention to provide more harmonious stringed musical instruments.

It is yet another object of the present invention to provide better harmony for an instrument with itself.

It is yet another object of the present invention to provide an ensemble of integrally harmonious instruments.

It is yet another object of the present invention to provide harmonious musical instruments by tuning them in fifths.

It is yet another object of the present invention to have symmetry of playing positions by having five strings in a musical instrument tuned in fifths.

These and other objects and advantages of the present invention will be apparent from a review of the following specification and accompanying drawings.

BRIEF DESCRIPTION OF THE DRAWINGS

FIG. 9 also shows the stepped off-set present for the lowest string.

FIG. 19 shows the tablature (hereinafter "PENTATABLATURE") for the violin clef.

FIG. 20 shows the PENTATABLATURE for the generic bass clef.

FIG. 21 shows the PENTATABLATURE for the A-tuned PENTABASS, a 5-string electric bass guitar disclosed herein.

FIG. 22 shows the PENTATABLATURE for a C-tuned PENTABASS or PENTACELLO.

FIG. 23 shows the PENTATABLATURE for the D-tuned PENTABASS.

FIG. 24 shows the PENTATABLATURE for the G-tuned PENTACELLO.

FIG. 25 shows the PENTATABLATURE for the A-tuned PENTACELLO.

FIG. 26 shows the PENTATABLATURE for the D-tuned PENTATAR and the D-tuned PENTALIN.

FIG. 27 shows the PENTATABLATURE for the E-tuned PENTATAR.

DESCRIPTION OF THE PREFERRED EMBODIMENT(S)

Figure 1:
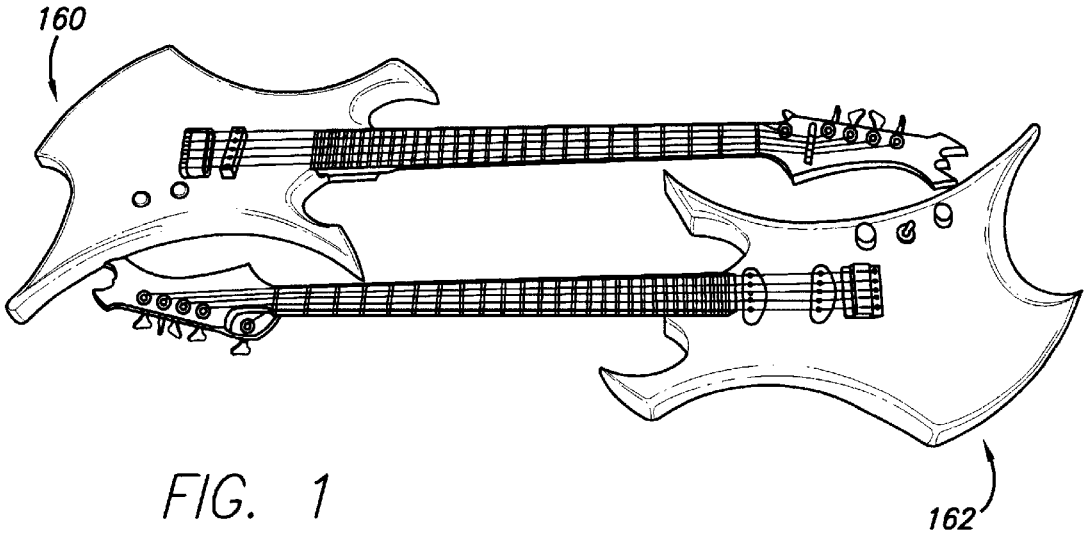
FIG. 1 shows top perspective views of a PENTATAR and a PENTACELLO.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

As shown in the drawings and as set forth in more detail herein, the improved stringed musical instruments set forth herein and the method therefor of achieving such improved stringed musical instruments is derived from a foundation of internal and consistent harmony throughout the individual instrument. Additionally, combinations or an ensemble of such instruments may not only be integrally constant and harmonious, but tuned such that each instrument is constant and harmonious with all others.

Figure 2:
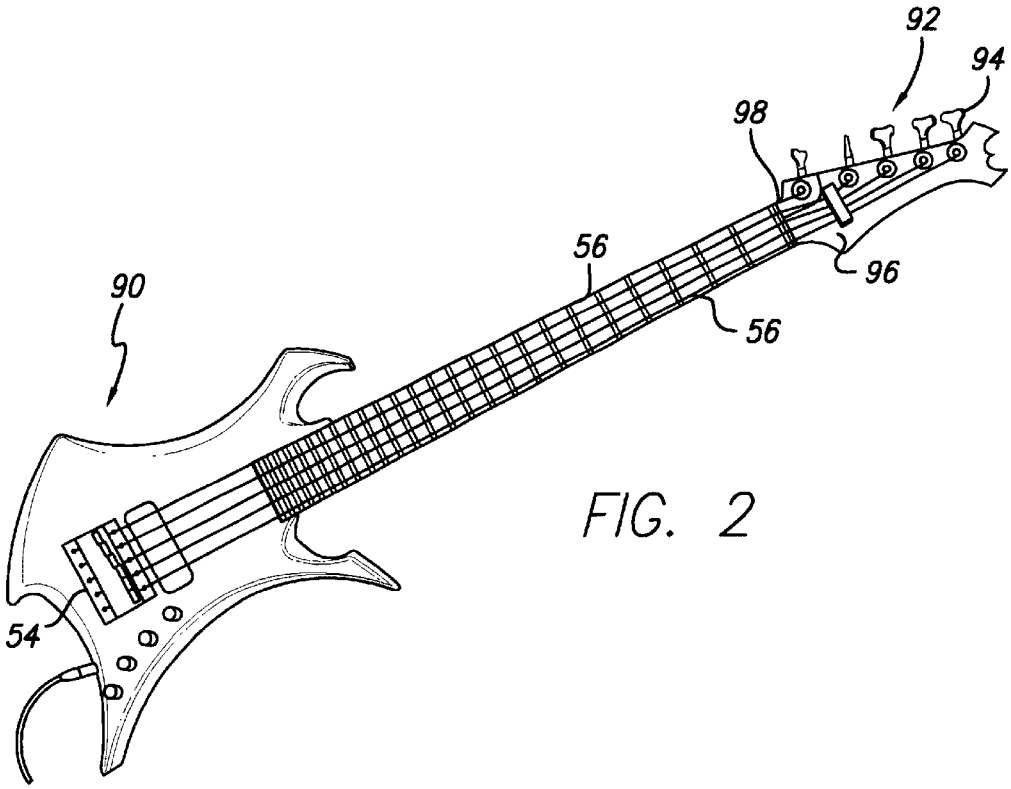
FIG. 2 is a front view of a 5-string bass guitar, the PENTABASS, according to the present invention incorporating both the adjustable bridge, tension bar, and compound headstock.
Figure 3:
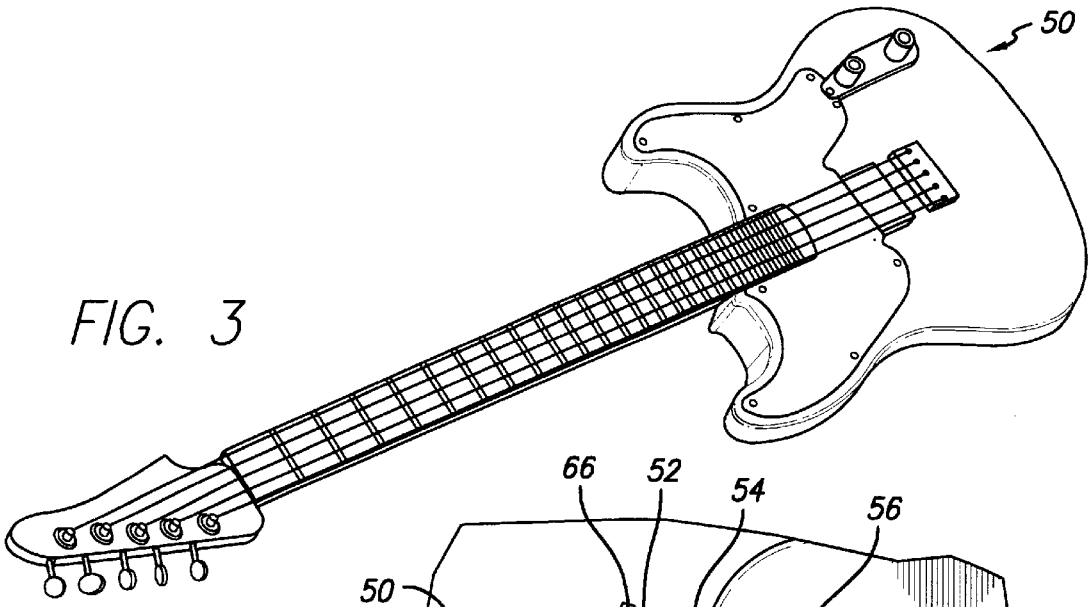
FIG. 3 is a top front perspective view of a 5-string instrument constructed according to the present invention and denominated as a CELLOBLASTER or PENTACELLO.

FIGS. 1–3 show 5-stringed instruments incorporating the PENTA system of the present invention. The PENTA system not only tunes each 5-stringed instrument in fifths (with each string being a fifth above the lower string), but also creates harmony as an integral part of the instrument. Each part of the instrument, particularly those music-making portions of it, should operate harmoniously with the other portions of the instrument. In the stringed instruments shown in FIGS. 1–3, this is achieved by causing each string to be harmonious with itself along its entire length. From the bridge to the turnable tuning posts, a segment of the string defined by the instrument is harmonious with the other string segments.

Figure 4:
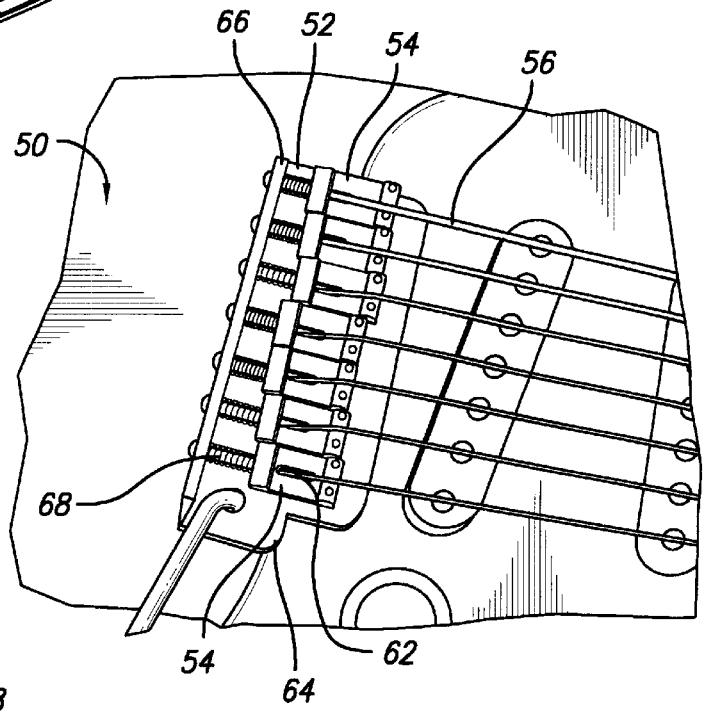
FIG. 4 is an enlarged view of an adjustable bridge of a 7-stringed electric guitar.

Such consonance according to the PENTA system of the present invention can be achieved in other types of instruments, as well. The area around the bridge of such a 7-string guitar is shown in FIG. 4. There, a 7-stringed electric guitar 50 has a bridge 52 with adjustable saddles 54, one for each of the seven strings 56.

Figure 5:
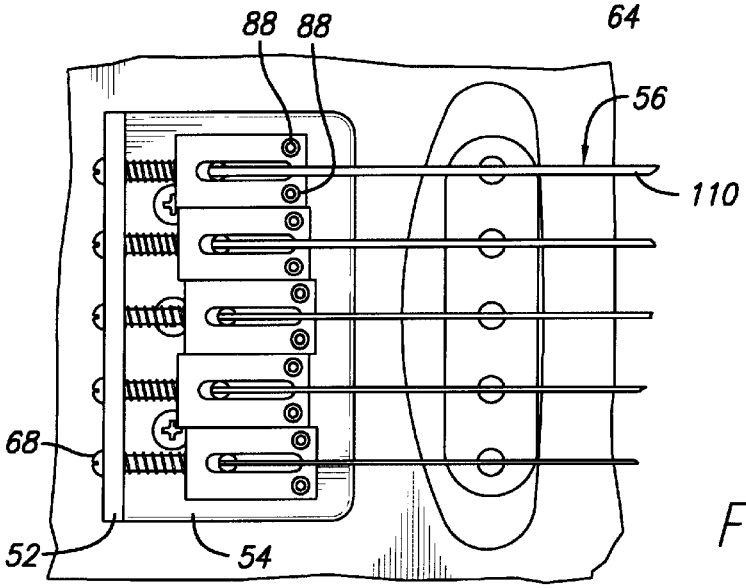
FIG. 5 is a perspective view of the bridge and pick up of the PENTACELLO shown in FIG. 1.

FIG. 5 also shows a bridge, with adjustable saddles 54. This style of bridge 52 may be used for the PENTACELLO (FIG. 1), the PENTATAR (FIG. 1), and the PENTABASS (FIG. 2).

As shown in FIG. 4, each of the strings 56 descend into the body of the guitar 50 immediately after passing the saddles 54. The saddles 54 each have slots 62 through which the strings 56 pass. In FIGS. 4 and 5, the bridge 52 has a chassis, or base plate, 64 that is attached to the body of the guitar 50. One end of the chassis 64 stands upright and away from the body of the guitar 50, generally as an extension or flange 66. Screws, bolts, or the like 68 threadably engage the saddles 54 with their slots 62. By threadably adjusting the location of a saddle 54, the tension upon the associated string 56 may be adjusted, as well as the location of the point (a stop) at which waves oscillating along the main music-making portion of the string are reflected back up the string towards the neck and the nut 98 (FIG. 8) at the opposite end of the guitar 50.

As can be seen by inspection of FIG. 4, the range of travel of the saddles 54 is limited to that of the extent of the slot 62 relative to the fixed end of the string.

As shown in FIG. 5, bridges of a similar style may be used for the PENTACELLO (FIG. 1), the PENTATAR (FIG. 1), and the PENTABASS (FIG. 2). The saddles shown in FIGS. 4 and 5 are very effective in defining the action in the string. However, in all of these bridges, the string attaches to the body of the guitar directly below the bridge. In some embodiments, particularly those implementing the present invention, it is sometimes advantageous to have a length of string extend past the saddle, so as to define different tension and a harmonic element that vibrates in sympathy with the main portion of the string 56.

Figure 6:
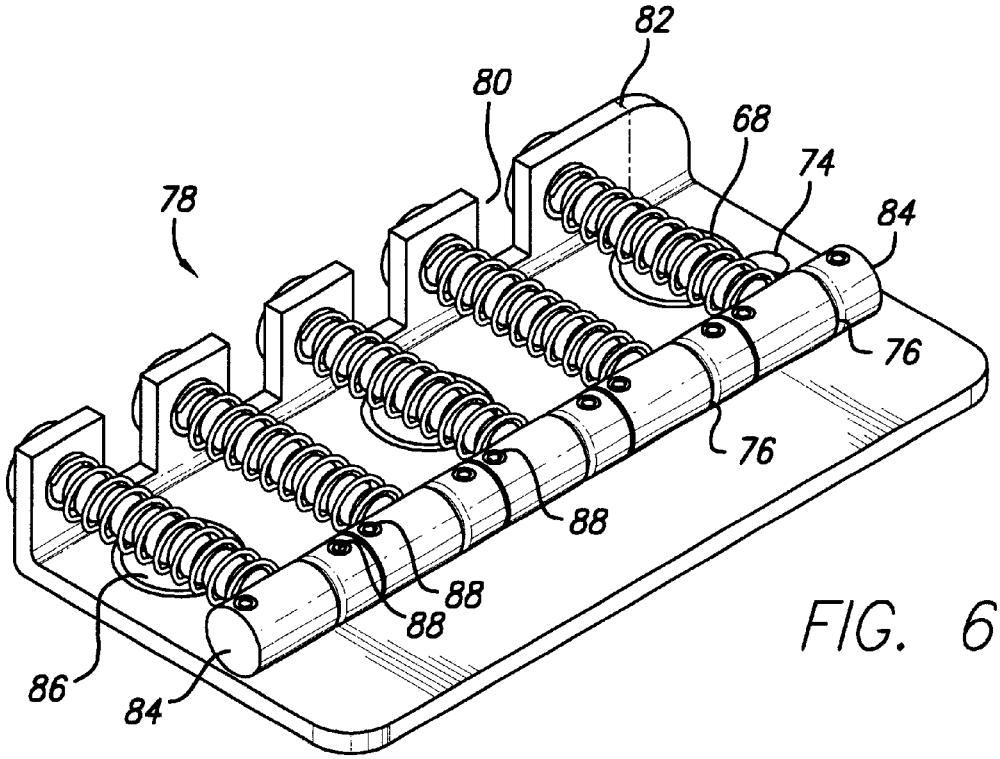
FIG. 6 is a front perspective view of an adjustable bridge of the present invention.
Figure 7:
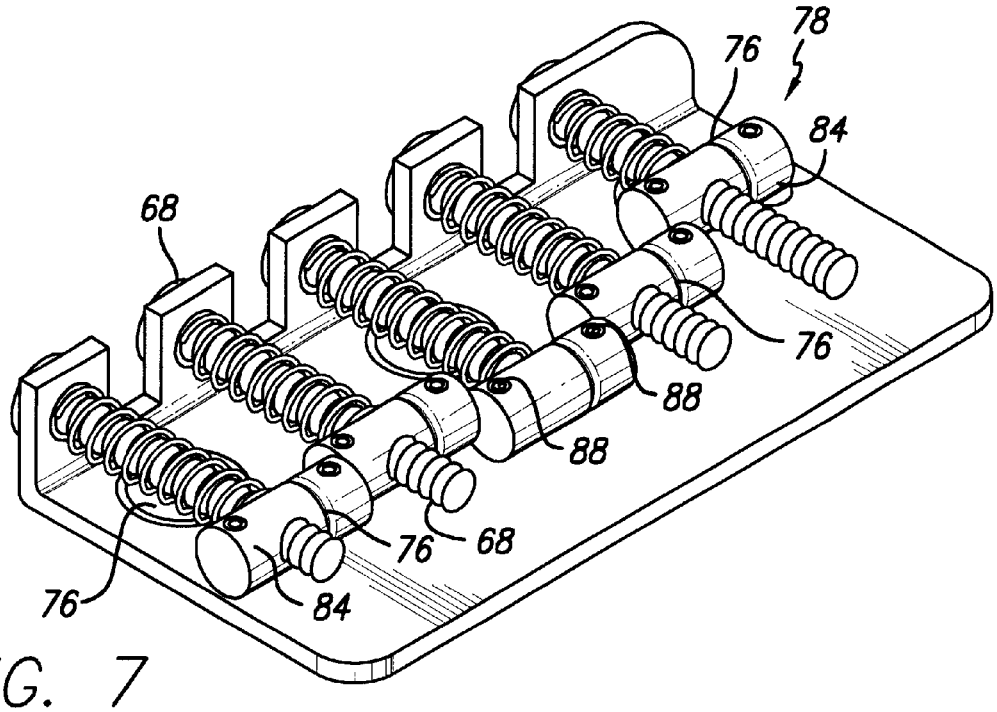
FIG. 7 is a front perspective view of the adjustable bridge of FIG. 6 with the saddles offset from one another.

FIGS. 6 and 7 show an alternative embodiment of the bridge 52 shown in FIGS. 4 and 5. In FIGS. 6 and 7, the structures and elements are generally the same as those shown in FIGS. 4 and 5. However, FIGS. 6 and 7 also provide crenels 80 through which the strings 56 may pass on their way to attachment to the guitar body.

In comparison with the saddles 54 of FIGS. 4 and 5, which are generally grooved centrally and generally in alignment with the adjustment screw 68, the saddles 84 of the bridge 78 of FIGS. 6 and 7 are generally grooved at one end in alignment with the crenels 80.

In this way, adjustment or selection may be made in the fixing of the base end of the string to the body of the guitar 50. This provides means by which the tension on the string 56 may be adjusted. The harmonic resonance between the first portion of the string between its fixed end and the saddle 84 may be adjustably matched with that of the music-making portion of the string between the saddle 84 and the nut 98. The crenels 80 allow strings of a variety of lengths to be used. Springs 86 may serve to keep the saddles 84 in tension against the threads of the bolts 68 as shown in FIGS. 6 and 7. Such springs 86 may also be used to keep the saddles 54 in tension as shown in FIGS. 4 and 5.

In an alternative embodiment, an end crenel or notch 82 (shown in phantom in FIG. 6) may be present at one end of the bridge 52. However, as shown in FIGS. 6 and 7, a hole 74 is provided in the bridge for fixing the lowest string. This provides more tension for the first string. The remaining strings may pass through the crenels 80. The increased length of the other strings serves to reduce their tension.

For the bridges shown in FIGS. 4–7, not only can the saddles 54, 84 define the point at which a node occurs, but also the tension on the string. Each saddle 84 has two-height adjustment screws 88.

By threadably moving the adjustment screws 88 through the saddle 84, the height of the saddle may be altered. As the string 56 exerts downward pressure upon the saddle 84 towards the bridge, lowering the saddle 84 slightly reduces tension upon the string 56. Raising the saddle 84 slightly increases the tension upon the string 56.

Figure 8:
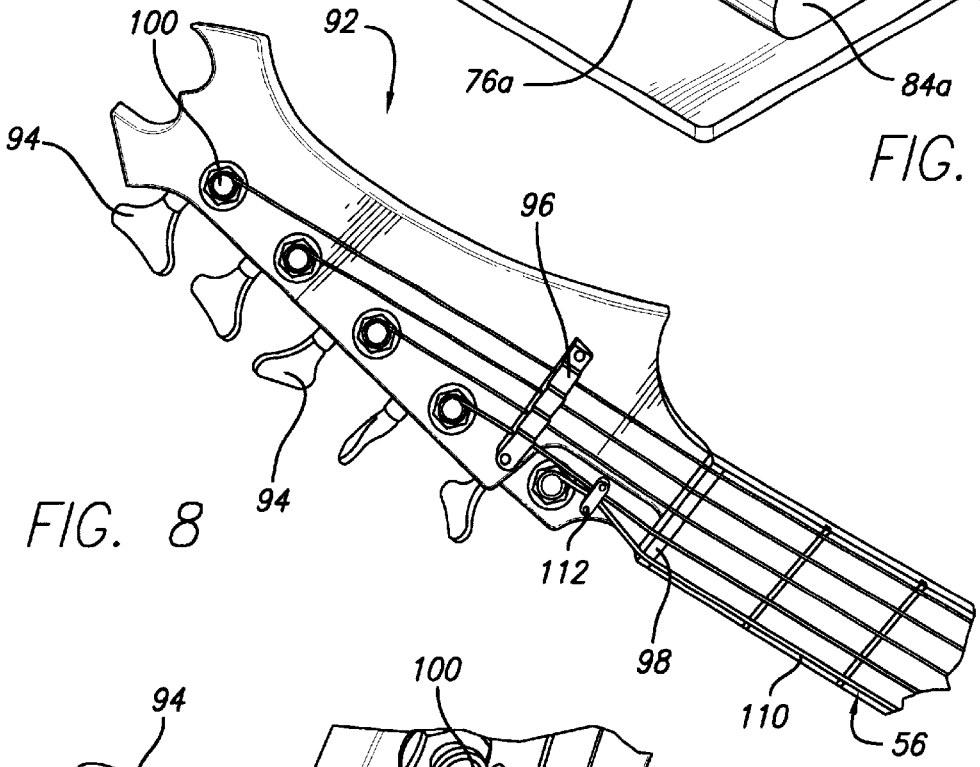
FIG. 8 is a front perspective view of a compound headstock used on the PENTABASS shown in FIG. 2, incorporating the tension bar, or stepped string retainer, as set forth in the present invention.
Figure 9:
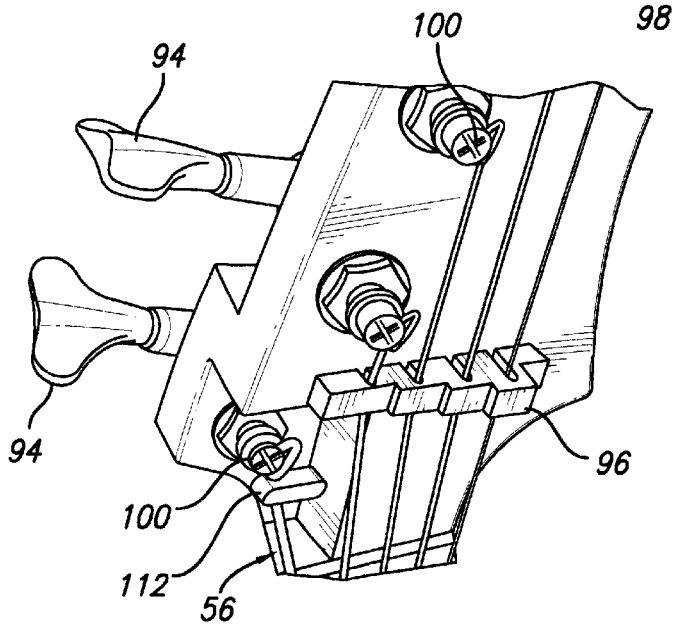
FIG. 9 is an enlarged perspective view of the bar, or stepped string retainer, of FIG. 8.
Figure 12:
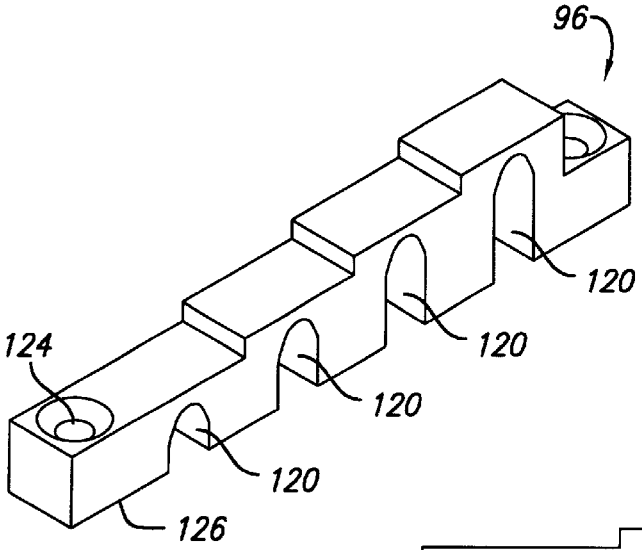
FIG. 12 is a perspective view of the tension bar, or stepped string retainer, of the present invention.
Figure 13:
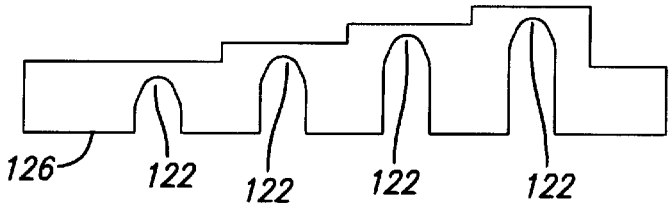
FIG. 13 is a side plan view of the tension bar, or stepped string retainer, of the present invention.

FIGS. 2, 8, and 9 show various aspects of a 5-string bass guitar in conformance with the PENTA system musical instrument configuration of the present invention. FIGS. 12 and 13 show a stepped string retainer 96 used to effect the PENTA system of the present invention.

A bass guitar 90 having five (5) strings (FIG. 2) may be constructed according to the principles of the present PENTA system invention. FIG. 8 shows important aspects of the compound head 92 with its keys 94, stepped string retainer 96 and nut 98. These features are shown in an enlarged or magnified presentation in FIG. 9. As is normal for stringed instruments, the nut 98 provides a reflection point at which waves travelling along the main music-making portion of the string are reflected back towards the bridge 52. However, the nut 98 defines a node, or stop, which allows energy to be transmitted past the nut 98 and on to the remaining string portion passing on to the key 94 with its turnable post 100.

Each string 56 passes through its groove in the nut 98 and on to its turnable post 100 controlled by the associated key 94. For each string, the string is wrapped around the turnable post 100 which then also forms a reflection point at which waves are reflected back from the turnable post 100 along the string 56 and on to the nut 98. Optimally, the distance between the nut 98 and the turnable post 100 for each string 56 is such that the fundamental frequency of that string segment is harmonious with the remaining portions of the string, particularly the music-making portion of the string 110.

In most stringed instruments, the tension on the various strings may differ. In order to achieve the tones necessary for melodic or other tone-based music-making, both the tension and the width of the string are varied in order to achieve the variety of tones. However, with different strings at different tensions, it becomes a more difficult endeavor to play the stringed instrument as the feel of the strings is not consistent from one string to another. While the width of the strings may be compensated for fairly easily, the varieties of tension forces the musician to alter the plucking and/or strumming techniques in order to control important features of the sound generated.

In the present invention, more uniform tension of the strings is obtained by two devices: a compound headstock angled off from the fret board (FIGS. 15 and 16) and/or the use of a stepped string retainer 96. The compound headstock is set forth in more detail below. However, FIG. 9 shows one example on a single string of a PENTABASS shown in the Figures.

The lowest bass string (according to the PENTA system, an Ab) is below the standard bass guitar or bass in tone. In FIGS. 8 and 9, the string of the Ab, or lowest, bass string descends from the nut 98 to engage a single string retainer 112. The string then travels on to the turnable post 100 for the lowest bass string, Ab, and key 94. The single string retainer 112 for the lowest bass string (in conjunction with the lower plane) may be positioned such that the waves reflected by it (and defined by it) are harmonious with the main music-making portion 110 of the string 56. The natural frequency of the string segment from the simple string retainer 112 and the nut 98 is harmonious with the main music-making portion of the string 56.

Figure 10:
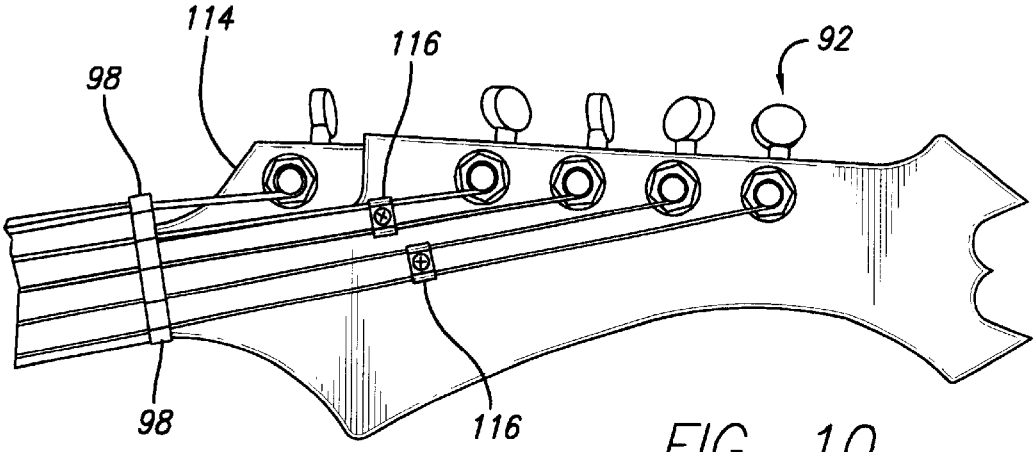
FIG. 10 is a top perspective view of a headstock of the PENTACELLO shown in FIG. 1, including two string trees for the top four strings.
Figure 11:
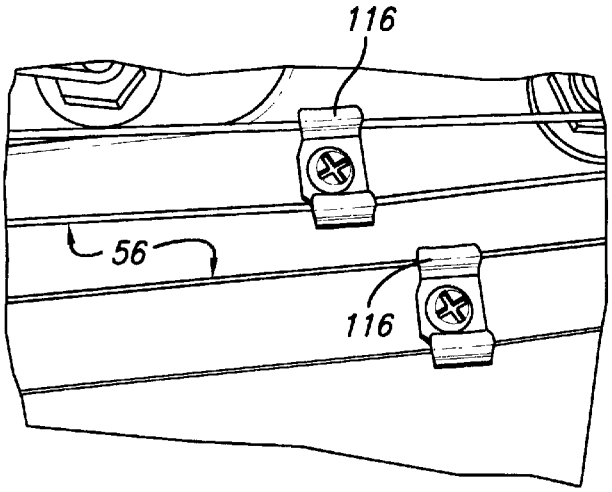
FIG. 11 is a close-up view of the string trees on the headstock of the PENTATAR shown in FIG. 1.

As shown in FIGS. 10 and 11, an alternative embodiment of the single string retainer 112 may be effectively achieved by a dual-string retainer 116. The dual string retainer 116 serves to retain the strings closer to the head by centrally engaging two strings 56 on either side of the dual string retainer 116. The dual string retainer 116 is also referred to as a string tree. Like the single string retainer 112, the string tree 116 establishes a node along the string 56. The natural frequencies of the stringed segments defined by a string tree 116 may then be chosen by a propitious location of the string tree 116. Energy then delivered to the string segments from the main music-making portion of the string 110 then drives the other string segments harmoniously.

Figure 14:
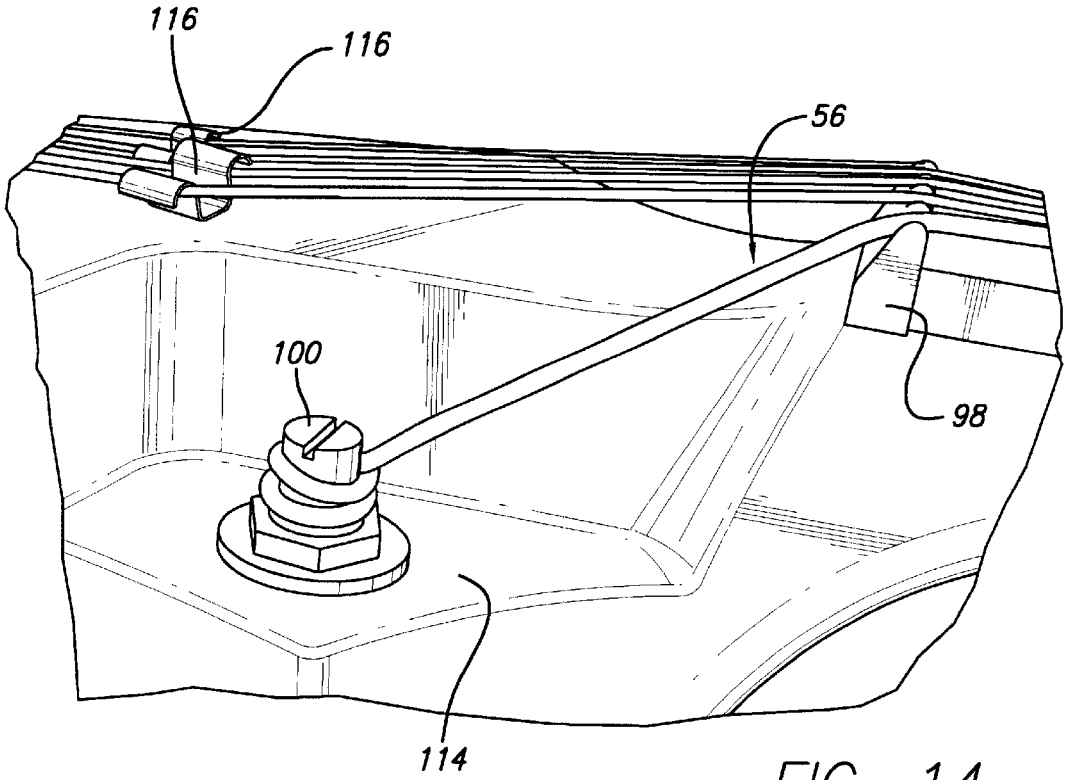
FIG. 14 is a top perspective view of the compound portion of the headstock for the PENTATAR shown in FIG. 1.
Figure 15:
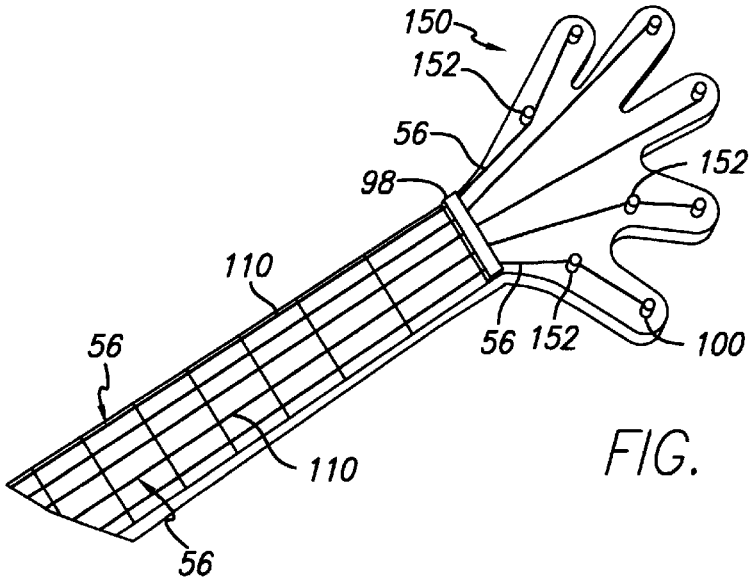
FIG. 15 shows a top schematic view of a compound headstock attached to a fret board according to the present invention.
Figure 16:
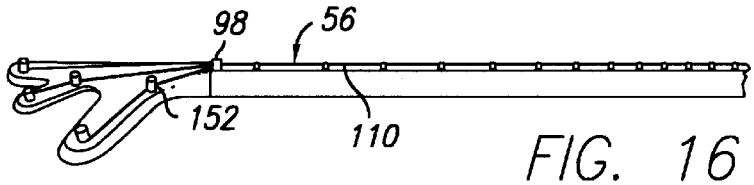
FIG. 16 shows a side schematic view of the headstock shown in FIG. 15, with the lowest bass string offset from the frame of the fret board.

By allowing the string to drop down away from the nut 98, the single step 114 taken by the head 92 allows the tension of the bass string to be increased while ensuring that the proper note is delivered by the string 56 (FIG. 14). As set forth herein, it is such head geometries that form a compound head 92, where the head 92 is formed to cause the strings to travel off the plane of the fret board. This may cause the individual keys and their turnable posts to be in different planes with respect to one another (FIGS. 15 and 16).

As also shown in FIG. 9, the multiple string tension retainer, or stepped string retainer, 96 provides reflection points for the strings engaged by it. Additionally, it causes the strings to travel in a manner that is non-linear or that is not straight with respect to the distance between the nut 98 and the string's turnable post 100. This provides means by which the strings may be subject to varying tensions, with higher-than-usual tensions delivered for the strings delivering lower notes. As consistent with the PENTA system set forth herein, reflection points established by the retainer 96 bar may be such that the lengths of string on either side fundamentally resonate at frequencies harmonious with the remaining portions, particularly the main music-making portion 110 of the strings 56.

FIGS. 12 and 13 show in greater detail the stepped string retainer 96 of the present invention. For single string retainers, such as the single string retainer 112 shown in FIG. 18 for the lowest Ab bass string, similar construction may be used to equalize tension. Such construction may also be used for the string trees 116 of FIGS. 10 and 11.

In FIG. 12, a stepwise construction is set forth that provides more downward pressure and greater tension for the strings with lower notes with lesser tension or deflection for the higher note strings. As shown in FIGS. 12 and 13, the stepped string retainer 96 of the present invention has a number of apertures 120, in this case four such apertures. As shown in FIG. 13, the engaging portion of the retainer 96 is a curved surface 122 that serves to constructively engage the string, restricting its vibrational activity at the point of contact. This establishes a node, or stop. FIG. 12 shows beveled screw holes 124 that allow for the attachment of the retainer 96 to the head 92 by means of screws, bolts, and the like.

The height of the apertures 120 depend on the original and desired height of the strings 56 above the head 92. If the strings 56 are to be relatively far away from the head 92 as they travel from the nut 98 to their turnable posts 100, the retainer 96 may also have apertures 120 of relatively tall stature. For closer clearances, the apertures 120 will be correspondingly diminished. The height of the apertures, that is the height of the curved engagement surfaces 122 from the bottom 126 of the string retainer 96, depend upon the string 56 height from the head 92 as well as the tension desired, and the particular strings.

As the height of the strings 56 from the head 92 is generally consistent, and as the construction of the string is also consistent, no need is currently seen for adjustable means for the string retainer 96 in order to selectively control the height of the engagement surfaces 122. However, such adjustability is within the scope of the present invention and may be achieved in a manner similar to that shown in FIGS. 4–7 for the bridge 52, 78 with its saddles 54, 84. The curved nature of the engagement surfaces 122 of the tension bar 96 allow it to constructively engage strings to pass through it from a variety of angles.

Greater control is delivered over the operating aspects of each of the strings 56 in order to deliver to the musician greater control over the music created. Such means include: the bridge 52 with its saddles 54 (FIGS. 4 and 5), the retainer bars 96, 112 and/or string trees 116, and the ability to control string tension and the ability to control the distance between the nut 98 and the turnable posts 100 of the keys 94 by means of a compound head or otherwise. Greater harmonies are then available to the musician, with correspondingly greater enjoyment for the audience.

FIGS. 1–3 show embodiments of stringed instruments using the PENTA system of the present invention. FIG. 1 shows both the PENTACELLO 160 and the PENTATAR 162. FIG. 2 shows the PENTABASS 90. FIG. 3 shows a 5-stringed instrument known as the CELLOBLASTER. The compound headstock (FIGS. 15 and 16) may also be used to complement and enhance such PENTA-based instruments to provide equal tension across the strings.

FIGS. 15 and 16 show a compound head off the angle of the fret board plane for a 5-string guitar or other instrument. The compound head 150 shown in these figures provides means by which the tensions may be made more equal on the strings 56. In order to enhance the tension-compensating nature of the compound head 150, bracing posts or the like 152 may be used that serve to affect the tension of the string 56 and the deflection angle between the turnable post 100 and the nut 98. Alternatively, a compound headstock such as that shown in U.S. Pat. No. 5,519,165 (issued to Gregory for a Compound Headstock for a Stringed Instrument) may be used to good advantage or adapted.

By providing both pre- and post-music-making string portion adjustability, the present invention provides better control over the tone and quality of the notes played by the music-making portion 110 of the string 56. Adjustment of the pre-music-making portion of the strings delivered by the bridge 52 with its saddles 54, while the post-music-making portion of the string adjustability is provided by the compound head 150 and the off-angle travel of the strings 56 as well as the string retainers 96, 112.

While the bridge 52, compound head 150 and string retainers 96, 112 provide better means by which control may be exercised over individual strings in a stringed instrument, the delivery of harmony within an individual string does not address the inter-string harmony and/or inter-instrument harmony necessary in order to reduce dissonance and discord. The PENTA system of the present invention goes further and provides means by which instruments may not only be made harmonious at the component level, but also at the instrument and ensemble level.

As set forth above, the use of fifths, that is tuning the strings so that there are three-and-a-half steps between the note of each string, provides means by which the harmonics of one note serve to drive more harmonically any unplucked, unstrummed, or undriven strings. Consequently, the collateral noises arising from the unstruck strings are in harmony with the notes intentionally played. Additionally, a high degree of musical and music-playing symmetry is introduced by using fifths.

Figure 17:
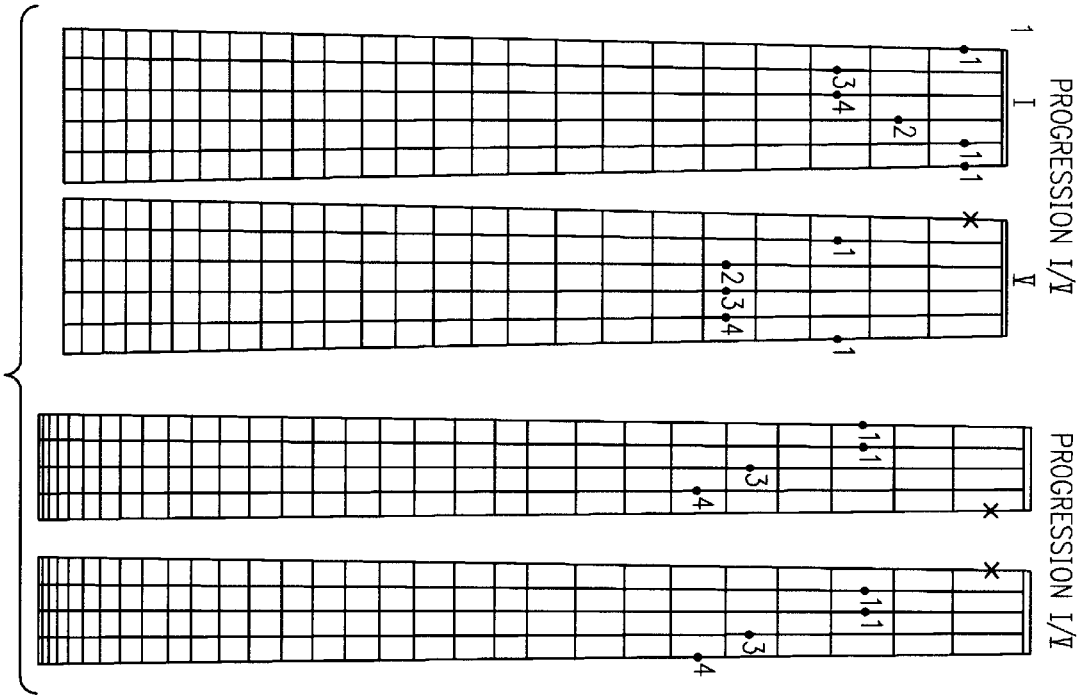
FIG. 17 shows a comparison between chord transitions for a guitar (on the left-hand side) and the 5-string PENTA system guitar, or PENTATAR. The transition shown is from a root chord to a fifth chord.
Figure 18:
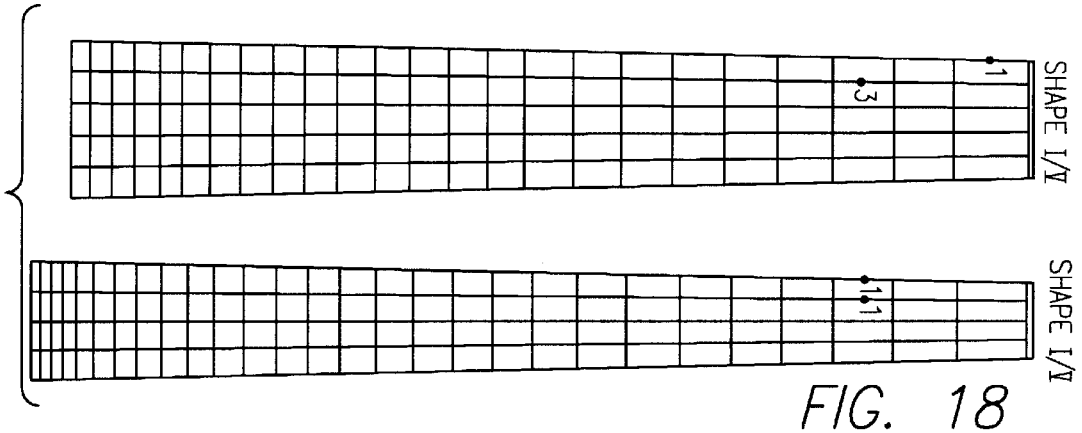
FIG. 18 shows the position of a root chord to a fifth for the guitar and the PENTATAR, along the lines as shown in FIG. 32.

FIGS. 17 and 18 show fingering diagrams for fret boards using a regular guitar as compared to a PENTA system guitar, PENTATAR. As shown in FIG. 17, the progression from a chord to its fifth is complex and requires refingering. FIG. 17 in its guitar section shows the progression from a root chord to a fifth chord, where the entire chord must be refingered. On the PENTATAR side of FIG. 17, the transition from a root chord to a fifth chord requires a simple shift of fingering up one string. This simple shifting provides a powerful tool by which more harmonic music can be realized in an easy manner. Ease arises in the present invention not only through the use of playing, but also in the ease of learning, in that the tuning in fifths spread over five strings is very easily understood.

Note should be taken that the lowest note in each guitar chord is exactly the same as the lowest note of each PENTATAR chord. Correspondingly, the highest note in each guitar chord is exactly the same as the highest note in each PENTATAR chord.

The symmetry with respect to musical travel in fifths not only corresponds to chords, but also to individual notes as well. In FIG. 18, the playing of a root note followed by a fifth requires greater fingering than is required for the same transition on a PENTATAR. As shown in FIG. 18, the first finger is used to define the root note, while the third finger is then required on the second string to define the fifth note. For the PENTATAR, the root-to-fifth transition takes place across the strings, requiring the use of a single finger. Consequently, the transition is much quicker. When the two notes are used to play a chord, the PENTATAR provides faster performance. As the PENTATAR allows the use of only one finger for the playing chords, such chords may be played very fast throughout the extent of the entire finger board with a maximum of ease. Such fast playing of chords is next to impossible on guitar, as shifting in fifths requires extensive fingering and/or re-fingering in order to maintain the relative tonal disposition between the notes of the chord.

Working from the basis of complete harmony from the component level to the ensemble, an entire PENTA system orchestra may be constructed and may comprise the following instruments: a PENTABASS, such as that shown in the figures, which is an electric 5-string bass guitar/mandolin-like instrument having special design; the PENTACELLO (or CELLOBLASTER) which is an electric 5-string guitar/cello/mandolin-like instrument also with a special design (FIG. 1); the PENTATAR, which is an electric 5-string guitar/mandolin-like instrument (FIG. 1); the PENTAULA, which is an electric 5-string mandolin/viola-like instrument; and the PENTALIN, which is an electric 5-string mandolin-like instrument. All of these stringed instruments incorporate special designs. Additionally, electronically or digitally-tuned drums, or similar percussion instruments that may be linked to a keyboard, may be used as well as the human voice. The stringed instruments of the PENTA system generally cover the widest available range for stringed instruments such that a number of octaves may be embraced by a PENTA system orchestra. All of the stringed instruments are generally 5-string instruments and are tuned in fifths in order to achieve more perfect harmony.

Preferably, the tuning of the stringed instruments is as follows. The PENTABASS is preferably tuned (from the lowest to the highest string) to the notes as shown in the six tuning formats as shown in the chart, below. In this and the other charts, the note is indicated followed by the gauge of the string for that note. By indicating the string gauge, the note's actual frequency is better indicated as a string of a certain gauge generally has a limited range within which the indicated note may be found.

CHART 1

| | | | | | | | | |
|---|---|---|---|---|---|---|---|---|
| 1) | Ab | (0.145") | 2) | A | (0.145") | 3) | Cb | (0.130") |
| | Eb | (0.105") | | E | (0.105") | | Gb | (0.090") |
| | Bb | (0.070") | | B | (0.070") | | Db | (0.055") |
| | F#b | (0.042") | | F# | (0.042") | | Ab | (0.035") |
| | C#b | (0.028") | | C# | (0.028") | | Eb | (0.020") |
| 4) | C | (0.130") | 5) | Db | (0.120") | 6) | D | (0.120") |
| | G | (0.090") | | Ab | (0.080") | | A | (0.080") |
| | D | (0.055") | | Eb | (0.050") | | E | (0.050") |
| | A | (0.035") | | Bb | (0.032") | | B | (0.032") |
| | E | (0.020") | | F#b | (0.018") | | F# | (0.018") |

The PENTACELLO (or CELLOBLASTER) is preferably tuned (from the lowest to the highest strings, as is assumed unless otherwise noted herein) to the notes as shown below in Chart 2. All of these notes are generally tuned at least an octave higher than the corresponding ones on the PENTABASS.

CHART 2

| | | | | | | | | |
|---|---|---|---|---|---|---|---|---|
| 1) | Gb | (0.080") | 2) | G | (0.080") | 3) | Ab | (0.075") |
| | Db | (0.055") | | D | (0.055") | | Eb | (0.050") |
| | Ab | (0.040") | | A | (0.040") | | Bb | (0.035") |
| | Eb | (0.023") | | E | (0.023") | | F#b | (0.019") |
| | Bb | (0.0135") | | B | (0.0135") | | C#b | (0.0115") |
| 4) | A | (0.075") | 5) | Cb | (0.067") | 6) | C | (0.067") |
| | E | (0.050") | | Gb | (0.043") | | G | (0.043") |
| | B | (0.035") | | Db | (0.029") | | D | (0.029") |
| | F# | (0.019") | | Ab | (0.016") | | A | (0.016") |
| | C# | (0.0115") | | Eb | (0.010") | | E | (0.010") |

Preferably, the PENTATAR is tuned to notes as shown in Chart 3, below. While it only has 5 strings, the PENTATAR with its 27 frets has far more range than the regular 6-string electric guitar. Further, the PENTATAR has greater range than some known 7-string electric guitars. All the strings of the PENTATAR may be tuned at least one octave above corresponding strings of the PENTABASS.

CHART 3

| | | | | | |
|---|---|---|---|---|---|
| 1) | Db | (0.060") | 2) | D | (0.060") |
| | Ab | (0.042") | | A | (0.042") |
| | Eb | (0.028") | | E | (0.028") |
| | Bb | (0.015") | | B | (0.015") |
| | F#b | (0.010") | | F# | (0.010") |
| 3) | Eb | (0.052") | 4) | E | (0.052") |
| | Bb | (0.036") | | B | (0.036") |
| | F#b | (0.024") | | F# | (0.024") |
| | C#b | (0.013") | | C# | (0.013") |
| | G#b | (0.009") | | G# | (0.009") |

The PENTAULA is preferably tuned as shown in Chart 4, below, with the strings generally tuned at least one octave higher than an accompanying PENTACELLO.

CHART 4

| | | | | | |
|---|---|---|---|---|---|
| 1) | Gb | (0.056") | 2) | G | (0.056") |
| | Db | (0.039") | | D | (0.039") |
| | Ab | (0.026") | | A | (0.026") |
| | Eb | (0.014") | | E | (0.014") |
| | Bb | (0.0095") | | B | (0.0095") |
| 3) | Ab | (0.050") | 4) | A | (0.050") |
| | Eb | (0.035") | | E | (0.035") |
| | Bb | (0.023") | | B | (0.023") |
| | F#b | (0.0125") | | F# | (0.0125") |
| | C#b | (0.0085") | | C# | (0.0085") |

The PENTALIN is preferably tuned to the notes as shown in Chart 5, below, with the strings generally tuned at least one octave higher than an accompanying PENTACELLO (tunings 3 and 4) or an accompanying PENTATAR (tunings 5 and 6).

CHART 5

| | | | | | | | | |
|---|---|---|---|---|---|---|---|---|
| 1) | Bb | (0.056") | 2) | B | (0.056") | 3) | Cb | (0.055") |
| | F#b | (0.039") | | F# | (0.039") | | Gb | (0.036") |
| | C#b | (0.026") | | C# | (0.026") | | Db | (0.024") |
| | G#b | (0.014") | | G# | (0.014") | | Ab | (0.013") |
| | D#b | (0.0095") | | D# | (0.0095") | | Bb | (0.009") |
| 4) | C | (0.055") | 5) | Db | (0.054") | 6) | D | (0.052") |
| | G | (0.036") | | Ab | (0.035") | | A | (0.034") |
| | D | (0.024") | | Eb | (0.023") | | E | (0.022") |
| | A | (0.013") | | Bb | (0.0125") | | B | (0.012") |
| | E | (0.009") | | F#b | (0.0085") | | F# | (0.008") |

Primarily, when as a coordinated ensemble, the foregoing PENTA-based instruments are generally tuned to separate, but adjacent, octaves.

The fully realized orchestra embodiment of the PENTA system, or PENTA orchestra, may have 13 members, including: a first DRUMMEPHONE having three octaves of digitally-tuned bass drum and snares; a second DRUMMEPHONE having three octaves of digitally-tuned high hat and timpani percussion; a third DRUMMEPHONE having three octaves of digitally-tuned ride and crush cymbals percussion; a PENTABASS; a first PENTACELLO alternating between low Ab and low Cb tuning; a second PENTACELLO strictly using low Ab tuning; a first and second PENTATAR; a PENTAULA; a first and second PENTALIN with the first PENTALIN being the lead instrumentalist of one embodiment of the PENTA orchestra; and first and second voices.

Where alternative tunings are used, such as those set forth herein, the several instruments may all re-tune to such alternative tuning configurations in an ensemble fashion.

When more than a single musical instrument, correctly tuned in fifths, is required in an ensemble or a full orchestra, the pentaprinciple of cycle of fifths may be used for maximum consonance. In either electric or acoustic set ups, the following arrangement of instruments may occur, from the lowest to the highest, to obtain such maximum consonance.

For a string quartet in a lowest tuning, the following tuning may be used:

| PENTABASS | CELLOBLASTER | 2 PENTAULAS |
|---|---|---|
| Ab/A | Ab/A | Ab/A |
| Eb/E | Eb/E | Eb/E |
| Bb/B | Bb/B | Bb/B |
| F#b/F# | F#b/F# | F#b/F# |
| C#b/C# | C#b/C# | C#b/C# |

Each instrument is generally tuned to separate octaves. For example, the CELLOBLASTER is tuned one octave apart from the PENTABASS, and the two PENTAULAS are tuned an octave apart from the CELLOBLASTER.

For a string quartet in a medium range tuning, the following tuning may be used:

| PENTABASS | PENTACELLO | 2 PENTALINS |
|---|---|---|
| Cb/C | Cb/C | Cb/C |
| Gb/G | Gb/G | Gb/G |

-continued

| PENTABASS | PENTACELLO | 2 PENTALINS |
|---|---|---|
| Db/D | Db/D | Db/D |
| Ab/A | Ab/A | Ab/A |
| Eb/E | Eb/E | Eb/E |

As for the lowest string quartet, the medium range string quartet has its instruments tuned an octave apart.

For a string quartet in a highest tuning, the following tuning may be used:

| PENTABASS | PENTACELLO | 2 PENTAULAS |
|---|---|---|
| Db/D | Ab/A | Ab/A |
| Ab/A | Eb/E | Eb/E |
| Eb/E | Bb/B | Db/D |
| Bb/B | F#b/F# | F#b/F# |
| F#b/F# | C#b/C# | C#b/C# |

In this case, the PENTACELLO may be tuned a fifth above the PENTABASS, while the PENTAULAS are tuned an octave above the PENTACELLO.

For an orchestra in a lowest tuning, the following tuning may be used:

| PENTABASS | 2 CELLOBLASTERS | 2 PENTATARS | 2 PENTALINS |
|---|---|---|---|
| Ab/A | Ab/A | Eb/E | Bb/B |
| Eb/E | Eb/E | Bb/B | F#b/F |
| Bb/B | Bb/B | F#b/F# | C#b/C# |
| F#b/F# | F#b/F# | C#b/C# | G#b/G# |
| C#b/C# | C#b/C# | G#b/G# | D#b/D# |

DRUMMEPHONES and vocalists may be added to this lowest-tuned orchestra. The CELLOBLASTERS may be tuned an octave above the PENTABASS, while the PENTATARS may be tuned a fifth above the CELLOBLASTERS. The PENTALINS may be tuned a fifth above the PENTATARS.

For an orchestra tuned in a medium range, the following tuning may be used:

| PENTABASS | 2 PENTACELLOS | 2 PENTATARS | 2 PENTALINS |
|---|---|---|---|
| Cb/C | Gb/G | D/D | Db/D |
| Gb/G | Db/D | Ab/A | Ab/A |
| Db/D | Ab/A | Eb/E | Eb/E |
| Ab/A | Eb/E | Bb/B | Bb/B |
| Eb/E | Bb/B | F#b/F# | F#b/F# |

DRUMMEPHONES and vocalists may be added to the medium-range orchestra. The two PENTACELLOS are tuned a fifth apart from the PENTABASS, while the PENTATARS are tuned a fifth from the PENTACELLOS. The two PENTALINS are tuned an octave apart from the PENTATARS.

For an orchestra in a highest range, the following tuning may be used:

| PENTABASS | 2 PENTACELLOS | 2 PENTAULAS | 2 PENTALINS |
|---|---|---|---|
| Cb/C | Cb/C | Gb/G | Db/D |
| Gb/G | Gb/G | Db/D | Ab/A |
| Db/D | Db/D | Ab/A | Eb/E |
| Ab/A | Ab/A | Eb/E | Bb/B |
| Eb/E | Eb/E | Bb/B | F#b/F# |

DRUMMEPHONES and vocalists may be added. The two PENTACELLOS are tuned an octave above the PENTABASS, while the two PENTAULAS are tuned a fifth above the PENTACELLOS. The two PENTALINS are tuned a fifth above the PENTAULAS.

For Greek duos, the following tuning may be used:

| PENTACELLO | PENTABOUZOUKI |
|---|---|
| Cb/C | cb/c |
| Gb/G | Cb/C |
| Db/D | Gb/G |
| Ab/A | Db/D |
| Eb/E | Ab/A |

DRUMMEPHONES and vocalists may be added per required enlargement. The PENTABOUZOUKIS may be tuned such that the note of the top PENTABOUZOUKI string is two octaves above the top, or lowest note, PENTACELLO string. The second PENTABOUZOUKI string may be one octave above the top PENTACELLO string.

For an Indian ensemble, the following tuning may be used:

| 2 PENTASITARS | 2 PENTAULAS |
|---|---|
| Db/D | Ab/A |
| Ab/A | Eb/E |
| Eb/E | Bb/B |
| Bb/B | F#b/F# |
| F#b/F# | C#b/C# |

The two PENTAULAS may be tuned a fifth apart from the two PENTASITARS. The thirteen sympathetic strings of the PENTASITARS are tuned in fifths.

A methodology is therefore established, whereby any music can be greatly improved, no matter the genre, by simply changing the wrong grouping of instruments with the closest right match in the previous charts.

For example, the traditional Greek bouzouki/guitar duo is replaced by the new system of 2 five-stringed instruments (PENTACELLO and PENTABOUZOUKI) as per described above. Although the preferred choice is electric PENTACELLO and PENTABOUZOUKI, acoustic instruments with corresponding scale lengths and stringings can be used.

A problem with acoustic instruments is that, for example, the top, sides and back of the soundbox, or sound board, have their own harmonics with possible conflict.

The tuning and the pairing according to the PENTASYSTEM will, no matter what, bring forth massive benefits to outweigh the added wrong acoustic frequencies created by the top, sides and back resonating.

Another example is the popular use of acoustic mandolins paired with acoustic guitars in Brazilian music and tonal culture. The corresponding correct instrumentation, in this case, will be the string quartet (medium range), with or without the PENTABASS of that chart, above.

In classical orchestras, the bass is wrongly tuned to the notes of E/A/D/G (from the lowest to the highest), and the correction would occur by using the chart for orchestras, above, chosen according to the piece that needs to be performed.

For example, Beethoven's Fifth Symphony is in Cm, therefore in that case the right choice would be the medium-range orchestra, where the wrong bass is replaced by the correct PENTABASS tuned to C/G/D/A/E.

Violins and violas have, in that symphony, parts written within their less desirable range of 4 strings instead of 5 but are not out of tune. Therefore, for the sake of tradition, the tuning of the violins and violas can be left alone, but the bass needs to be corrected.

A minimal improvement to the overall sound and sonic performance of at least 30% would be achieved such way, making the Fifth Symphony that much better than even Beethoven heard it. Similarly, additional orchestral changes can be made to other musical works.

The following table of conversions shows how to redesign acoustic instruments to their equivalent PENTASYSTEM instrument. The complete improvement brought forth by solid body electric PENTA instruments is compromised (by the use of acoustic instruments) to an extent by the need to keep a certain amount of tradition, but an average improvement of roughly 40% is achieve anyway.

TABLE OF CONVERSIONS

| | | |
|---|---|---|
| PENTABASS tuned to a bottom Ab/A | = | Scale length of 34" |
| PENTABASS tuned to the bottom Cb/C | = | Scale length of 33" |
| PENTABASS tuned to the bottom Db/D | = | Scale length of 32" |
| PENTACELLO tuned to the bottom Gb/G | = | Scale length of 26¼" |
| PENTACELLO tuned to the bottom Ab/A | = | Scale length of 25¾" |
| PENTACELLO tuned to the bottom Cb/C | = | Scale length of 25½" |
| PENTATAR tuned to the bottom Db/D | = | Scale length of 25¼" |
| PENTATAR tuned to the bottom Eb/E | = | Scale length of 25" |
| PENTAULA tuned to the bottom Gb/G | = | Scale length of 21" |
| PENTAULA tuned to the bottom Ab/A | = | Scale length of 19" |
| PENTALIN tuned to the bottom of Bb/B | = | Scale length of 14¼" |
| PENTALIN tuned to the bottom of Cb/C | = | Scale of 14" |
| PENTALIN tuned to the bottom of Db/D | = | Scale length of 13¾" |

It is assumed that the instruments with above scales will have no compound headstocks and possibly even gut or nylon strings, therefore they differ somewhat from the perfect solid body electric instruments of the complete PENTA system.

Optimally, the PENTA system conforms to the methodology expressed on the charts and is applied by solid body PENTA system instruments. The methodology is so perfect in itself that the compromise brought forth by the desire to use acoustic versions of the PENTA instruments will still produce a dramatic improvement over anything currently popular and used despite departure from an optimal arrangement.

One reason for the use of fifths in tuning the instruments of the present invention is that the fifth is the interval between any second harmonic and its third harmonic on a string. The second harmonic is an octave above that of the plucked or played note, while the third harmonic is a fifth. The interval between the octave and the twelfth is a fifth. D'Alembert, in light of speculations of Rameau, considered the fifth to be the most "consonant to the scheme of nature." The reference made above in the Background section to the work by Sir James Jeans may provide greater elaboration upon this. One advantage of the tuning in fifths set forth in the PENTA system of the present invention is that it generally avoids the occurrence of beats or the creation of a detectable third rhythm or character when two notes close together in tone are played simultaneously. Such beats or beating contributes to the discord or dissonance arising from the present arrangement of stringed instruments.

For open tuning, popular with some guitarists, a system has been discovered by which the impression of drawn strings and open tuning is retained, but the dissonance factor is eliminated resulting in a perfectly-tuned, open-tuned instrument. Generally, in an open-tuned 5-string instrument, the three middle strings are tuned a fifth apart with the two outer strings tuned an octave higher than the adjacent string, such that an open G tuning would have: a high G, a lower G, a D a fifth above the lower G, an A a fifth above the D, and another A an octave above the prior A.

Other instruments may be achieved that incorporate the PENTA system of the present invention. One such instrument is the PENTASITAR, having 13 sympathetic strings tuned to a cycle of fifths without a fret or fingerboard in conjunction with a basic PENTATAR. Resonance will occur in the sympathetic strings when notes are played on the PENTATAR. Thirteen low output alnico magnets may be used as pick-ups for the sympathetic strings so that they are not too strong in contrast or in competition with the notes made by the PENTATAR portion of the PENTASITAR.

A PENTABOUZOUKI may be constructed using a small combination of a guitar and a bouzouki and may be tuned to the notes as shown in Chart 6, below, as a 5-stringed instrument:

CHART 6

| | | | |
|---|---|---|---|
| 1) cb | (0.015") | 2) c | (0.014") |
| Cb | (0.035") | C | (0.034") |
| Gb | (0.023") | G | (0.022") |
| Db | (0.012") | D | (0.011.5") |
| Ab | (0.007") | A | (0.007") |

Figure 7A:
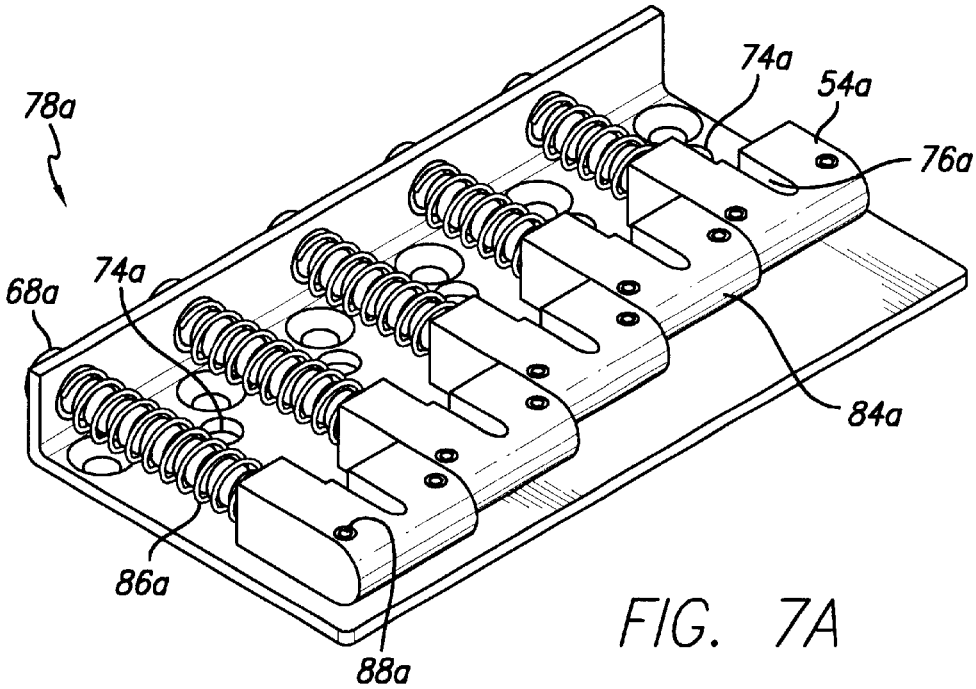
FIG. 7A is a right front perspective view of an alternative adjustable bridge.

In one embodiment, and as shown in FIG. 7A, the movable saddles 54*a* may have the following widths (in inches) going from the lowest string to the highest string: 25/32nds, 25/32nds, 23/32nds, 24/32nds, and 23/32nds. Specific string notches or grooves 76*a* are in the center of the saddles 84*a*, such that the effective compensated distance from string to string (from lowest to highest) 84*a* is 25/32nds, 24/32nds, 23.5/32nds, and 23.5/32nds.

Figure 7B:
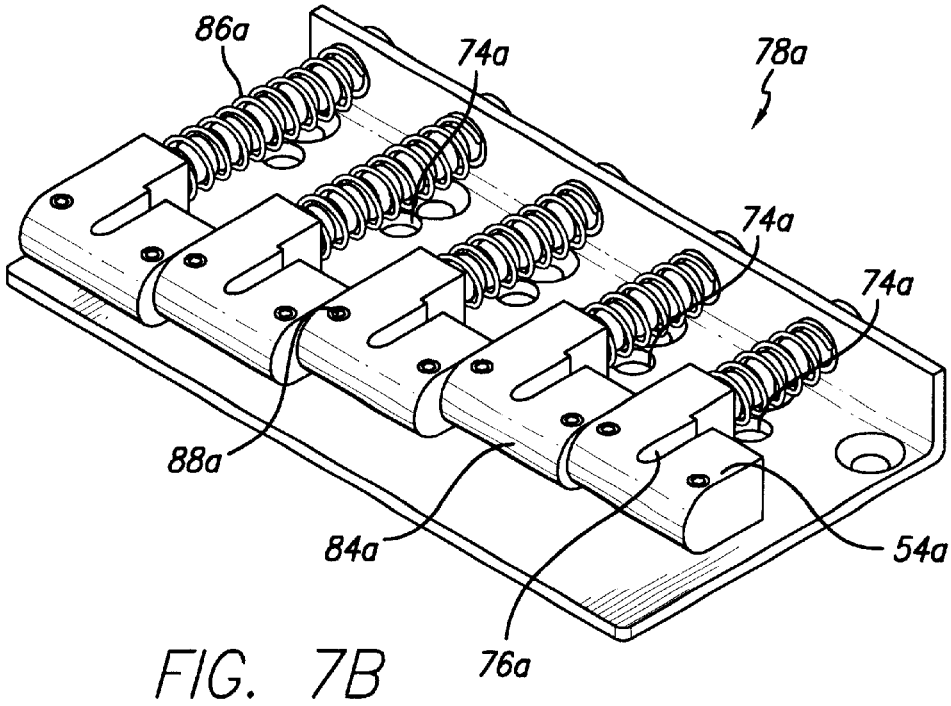
FIG. 7B is a left front perspective view of the adjustable bridge of FIG. 7A.
Figure 7C:
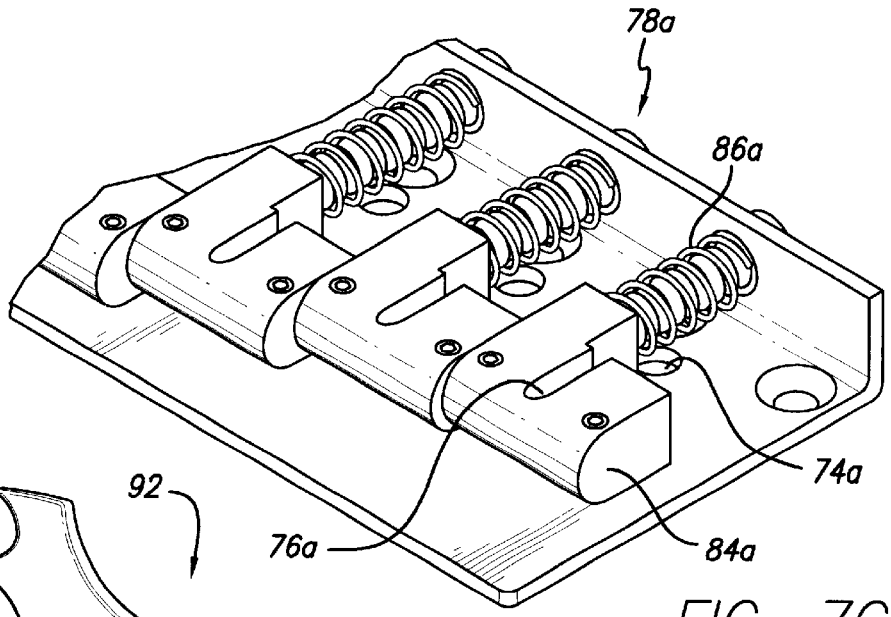
FIG. 7C is an enlarged view of the adjustable bridge of FIG. 7B, showing particularly the saddle for the first string.

As shown in FIGS. 7A, 7B, and 7C, the adjustable bridge 78*a* of the present invention may take alternative embodiments. Along the lines of the adjustable bridge 78 shown in FIGS. 6 and 7, the adjustable bridge 78*a* of FIGS. 7A, 7B, and 7C uses wider saddles 84A in order to achieve string support and stability. As set forth above, the saddles 84*a* may have specific tolerances and specifications in order to deliver specific interstring distances. As shown in FIGS. 7A–7C, the abuttingly adjacent nature of each of the saddles 84*a* provide for exact interstring distances. The saddles 84*a* slide with respect to one another and atop their saddle adjustment screws 88*a*.

Additionally, as the saddles 84*a* may be wider and longer than those shown in FIGS. 6 and 7, the grooves 76*a* for the strings 56 do not circumscribe the saddles 84*a*. Instead, they are edged angularly into the saddle 84*a* and are aligned with string holes 74*a*, which substitute for the crenels 80 (shown in FIGS. 6 and 7).

For the PENTALIN, the specially designed bridge as shown in FIGS. 6 and 7 allows for the travel of the strings past, even far past, the saddles 84. The crenels 80 allow the strings to travel past the bridge 78 to their fixed end points, which may be on the order of several inches from the bridge 78. For example, while the lower-most bass string may be strung through the body for tension, the next higher string may travel an inch or so past its saddle 84. The next and subsequent strings may each travel one inch further past the end of the lower string, such that the final or top string may be four or more inches further past the saddle 84 than for the lowest string.

Figure 19:
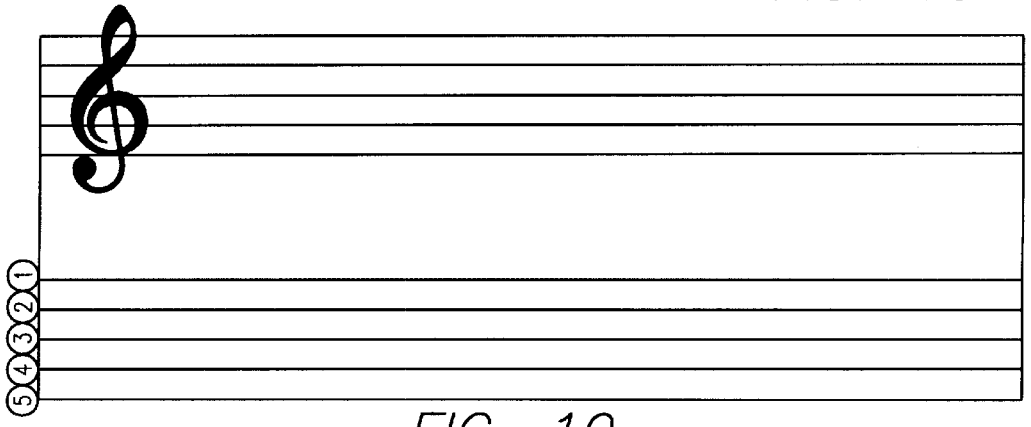
FIGS. 19–27 show tablature arrangements for use incorporating the tradition-breaking system of the present invention.

FIGS. 19–27 show a variety tablatures for use in the PENTA system of the present invention. FIG. 19 shows the violin or treble clef in the generic form for violins or other similarly-pitched instruments incorporating the PENTA system.

Figure 20:
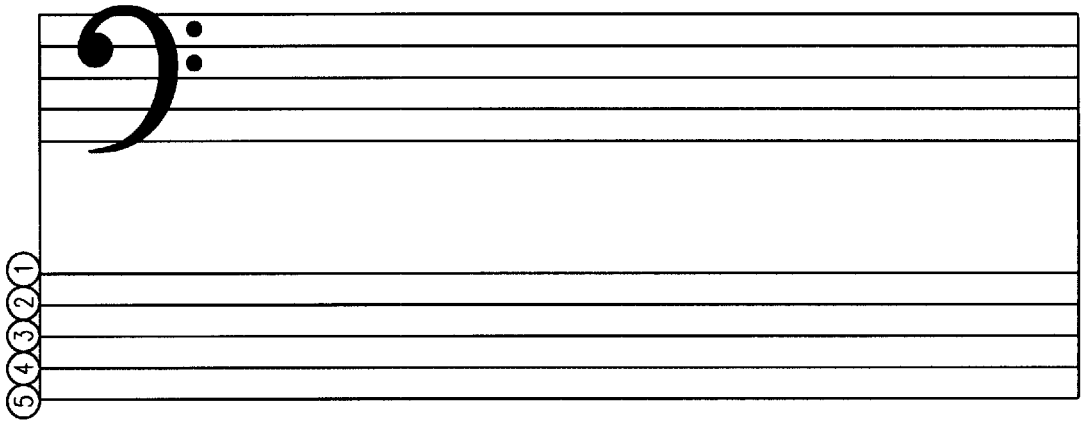

FIG. 20 shows a generic bass clef using the PENTA system, or PENTATABLATURE system, of the present invention.

Figure 21:
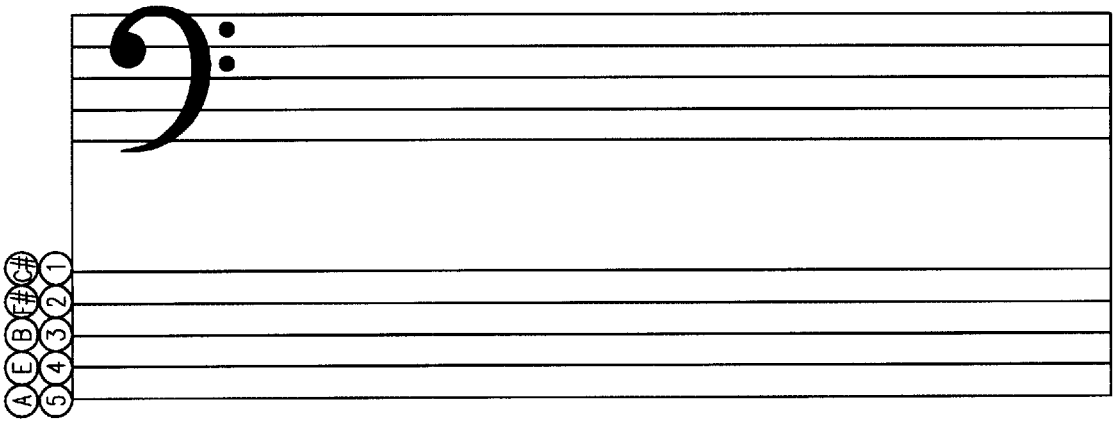

FIG. 21 shows the PENTATABLATURE for the PENTABASS with its A tuning of A, E, B, F#, and C# corresponding to individual lines on the staff. Some shifting of the notes (such as the use of 413.5 for A, as above) for notational purposes may be present herein.

Figure 22:
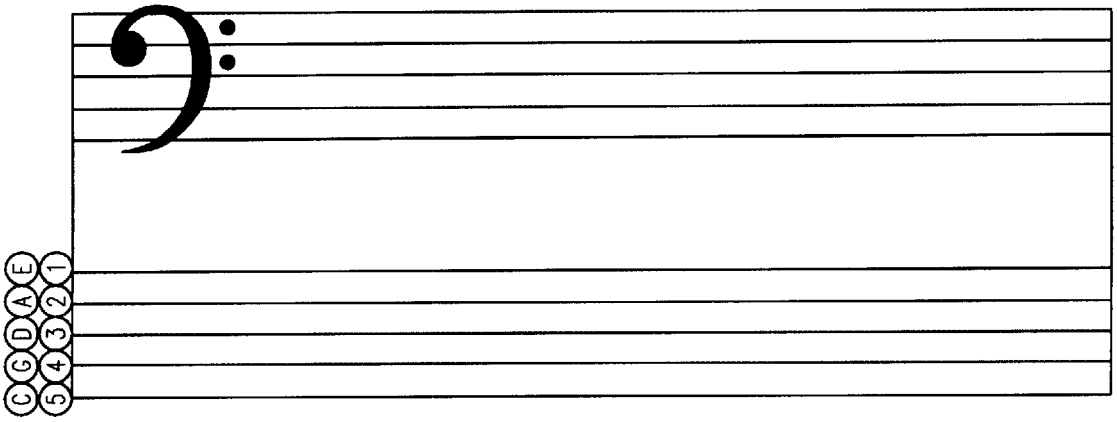

FIG. 22 corresponds to the PENTATABLATURE for a C-tuned PENTACELLO or PENTABASS with the staff lines corresponding to C, G, D, A, and E.

Figure 23:
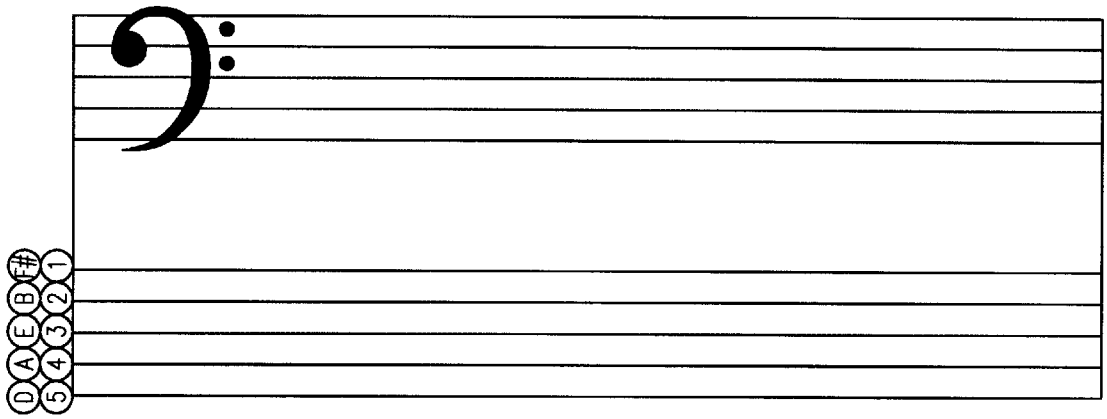

FIG. 23 shows the PENTATABLATURE for a D-tuned PENTABASS with the staff lines corresponding to the notes D, A, E, B, and F#.

Figure 24:
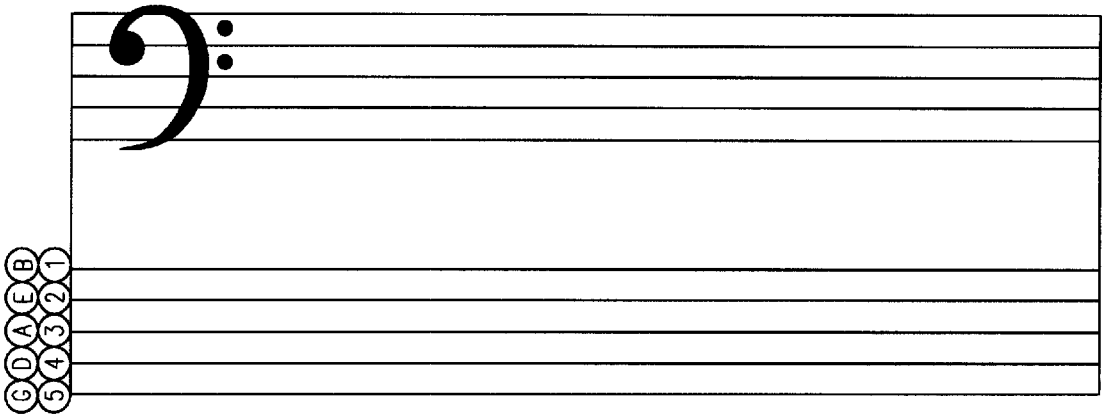

FIG. 24 shows the PENTATABLATURE for a G-tuned PENTACELLO with the staff lines corresponding to the notes G, D, A, E and B.

Figure 25:
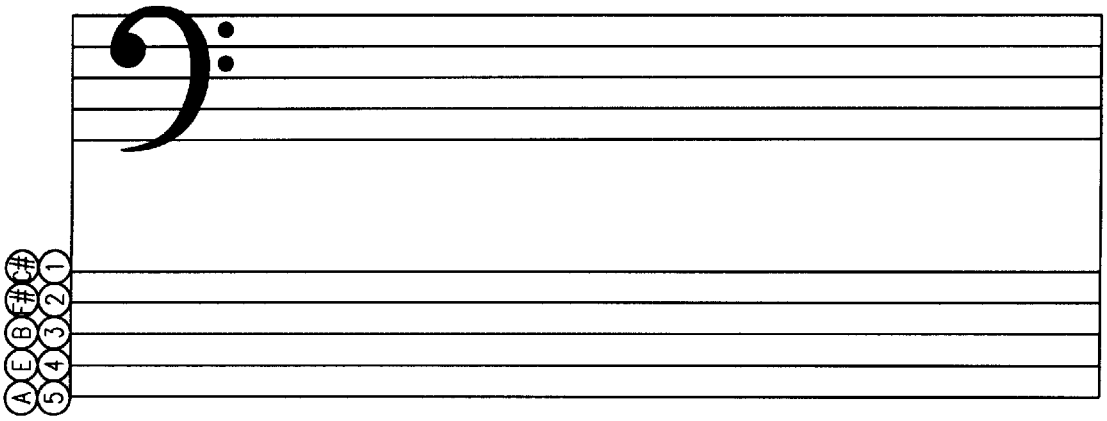

FIG. 25 shows the PENTATABLATURE for an A-tuned PENTACELLO with the staff lines corresponding from the lowest to the highest as indicated in the figure as A, E, B, F#, and C#.

Figure 26:
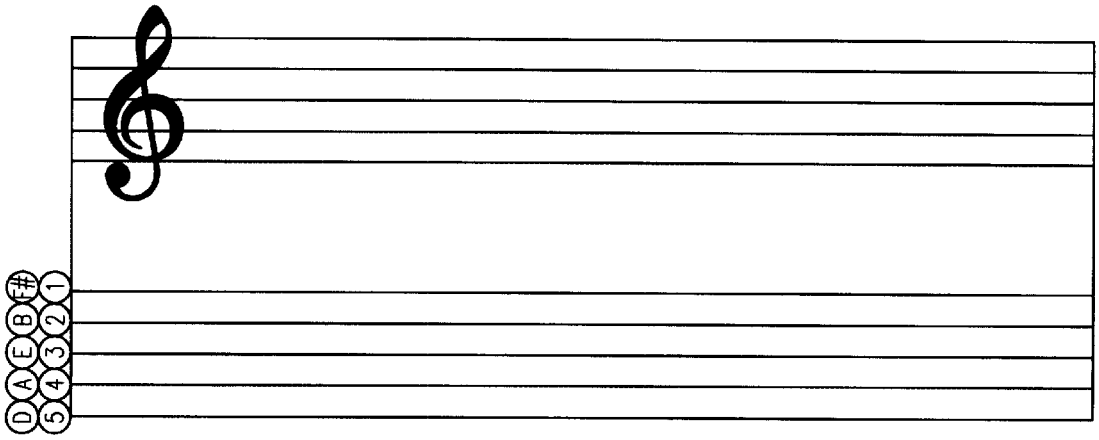

FIG. 26 shows the PENTATABLATURE for a D-tuned PENTATAR and/or D-tuned PENTALIN with the staff lines corresponding to D, A, E, B, and F#.

Figure 27:
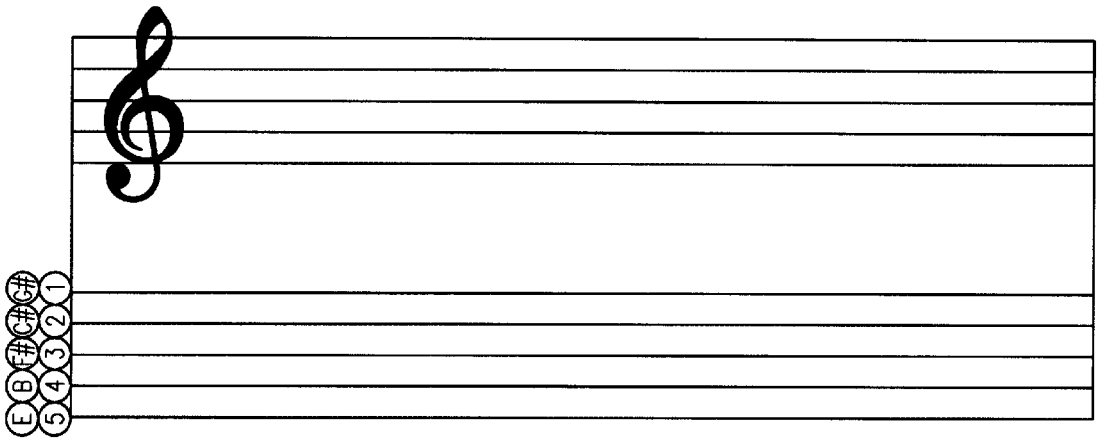

FIG. 27 shows the PENTATABLATURE for an E-tuned PENTATAR with the staff lines corresponding to E, B, F#, C#, and G#.

Figure 28:
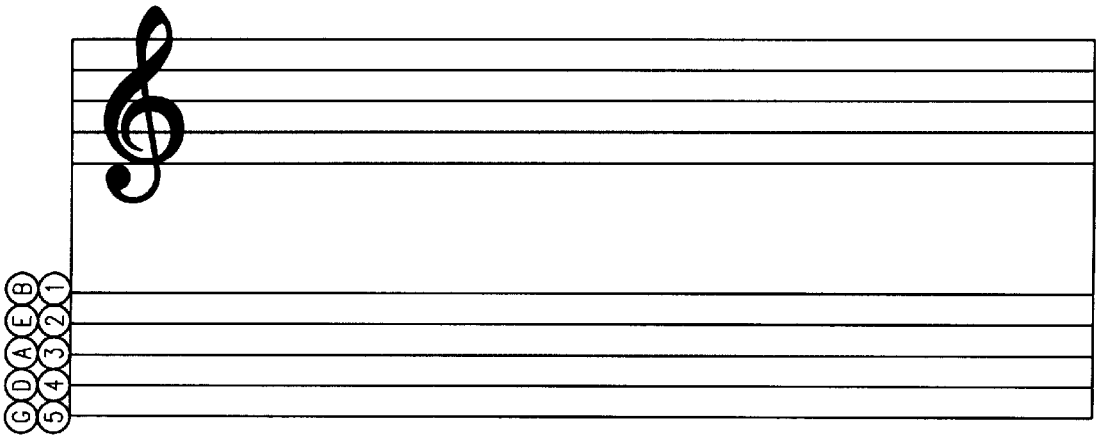
FIG. 28 shows the PENTATABLATURE for G-tuned PENTAULA.

FIG. 28 shows the PENTATABLATURE for a G-tuned PENTAULA with the staff lines corresponding to G, D, A, E, and B.

Figure 29:
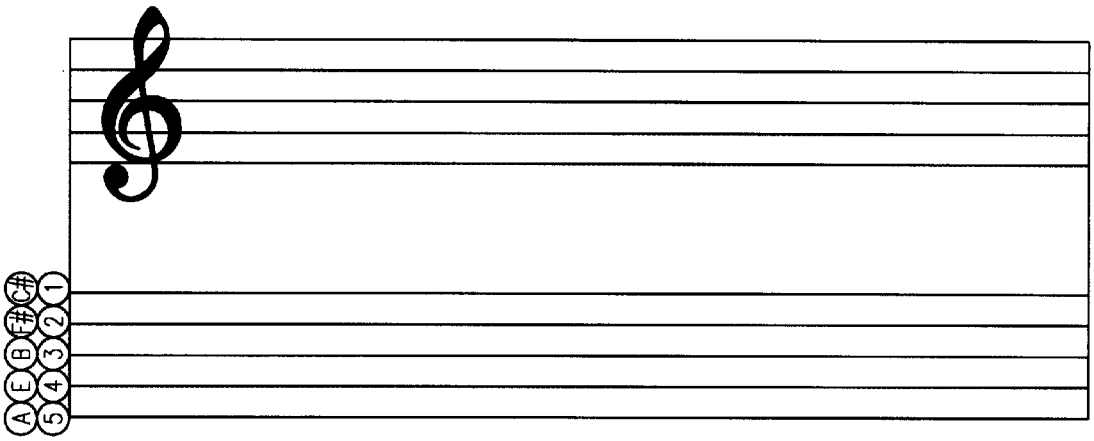
FIG. 29 shows the PENTATABLATURE for the A-tuned PENTAULA.

FIG. 29 shows the PENTATABLATURE for an A-tuned PENTAULA with the staff lines corresponding (from the lowest to the highest as indicated in the drawing): A, E, B, F#, and C#.

Figure 30:
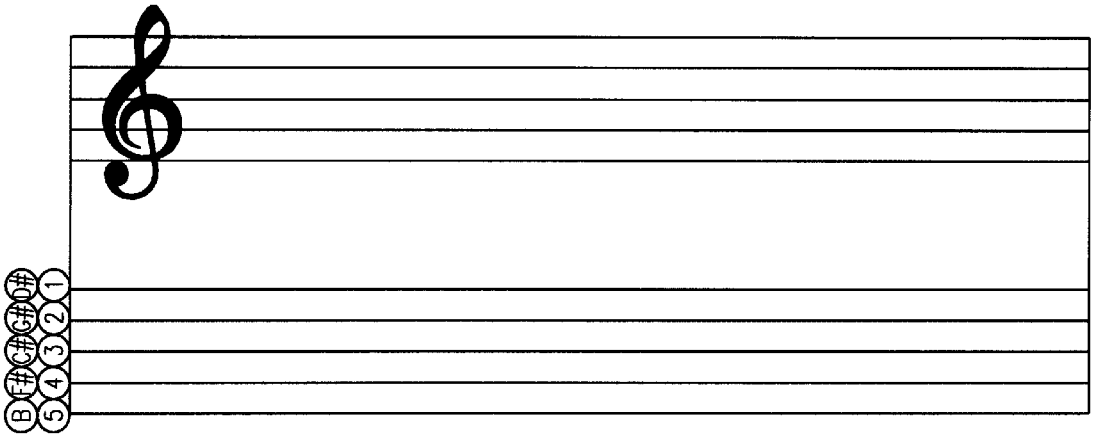
FIG. 30 shows the PENTATABLATURE for the B-tuned PENTALIN.

FIG. 30 shows the PENTATABLATURE for a B-tuned PENTALIN with the staff lines corresponding to B, F#, C#, G#, and D#.

Figure 31:
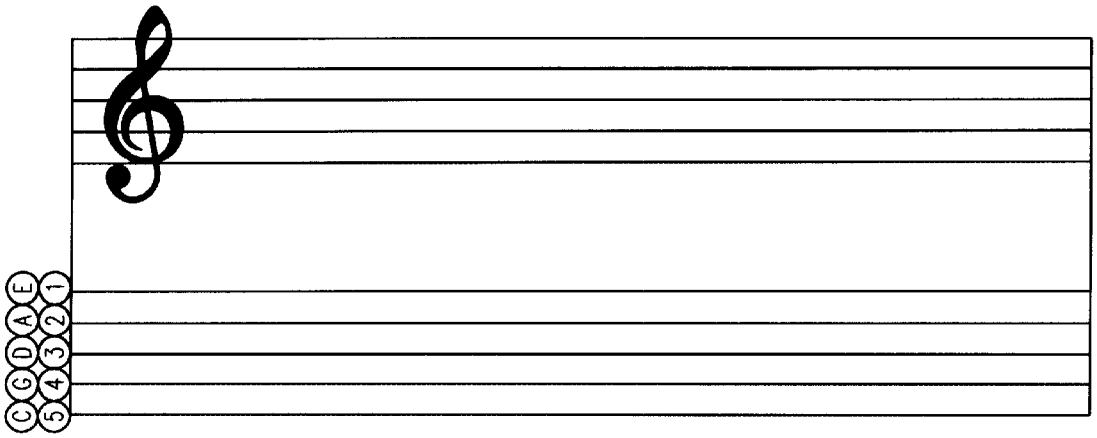
FIG. 31 shows the PENTATABLATURE for the C-tuned PENTALIN.

FIG. 31 shows the PENTATABLATURE for the C-tuned PENTALIN with the staff lines corresponding to C, G, D, A, and E.

While the present invention has been described with regards to particular embodiments, it is recognized that additional variations of the present invention may devised without departing from the inventive concept.

What is claimed is:

1. An integrally-harmonic stringed musical instrument, comprising:

a string, said string having a first end and a second end a first string holder for holding said first end of said string;

a second string holder for holding said second end of said string, said second string holder adjustably tensioning said string held by said first string holder;

a first stop, said first stop establishing a node for vibration of said string between said first and second string holders and dividing said string into first and second portions;

said first portion of said string a harmonic of said second portion of said string; whereby when said second string portion is struck, plucked, or driven, collateral energy delivered to said first portion of said string by vibrations of said second string portion cause said first portion of said string to vibrate harmonically, and not dissonantly, with said second portion of said string.

2. The integrally-harmonic stringed musical instrument of claim 1, further comprising:

a bridge, said bridge providing said first stop.

3. The integrally-harmonic stringed musical instrument of claim 2, wherein said bridge further comprises:

an adjustable saddle, said adjustable saddle engaging said string.

4. The integrally-harmonic stringed musical instrument of claim 1, further comprising:

a second stop, said second stop establishing a node for vibration of said string between said first stop and said second string holder and dividing said second string portion into third and fourth string portions;

said first portion of said string a harmonic of said third portion of said string; and said fourth portion of said string a harmonic of said third portion of said string; whereby when said third string portion is struck, plucked, or driven, collateral energy delivered to said first and fourth portions of said string by vibrations of said third string portion cause said first and fourth portions of said string to vibrate harmonically, and not dissonantly, with said third portion of said string.

5. The integrally-harmonic stringed musical instrument of claim 4, further comprising:

a nut, said nut establishing said second stop.

6. The integrally-harmonic stringed musical instrument of claim 4, further comprising:

a third stop, said third stop establishing a node for vibration of said string between said second stop and said second string holder and dividing said fourth string portion into fifth and sixth string portions; and said fifth and sixth string portions of said string a harmonic of said third portion of said string; whereby when said third string portion is struck, plucked, or driven, collateral energy delivered to said first, fifth, and sixth portions of said string by vibrations of said third string portion cause said first, fifth, and sixth portions of said string to vibrate harmonically, and not dissonantly, with said third portion of said string.

7. The integrally-harmonic stringed musical instrument of claim 6, further comprising:

a string retainer establishing said third stop.

8. The integrally-harmonic stringed musical instrument of claim 7, further comprising:

said string being a first string;

a second string;

said string retainer engaging said first string and said second string to both establish said third stop and to make more equal tension on said first string and tension on said second string; whereby said first and second string are held at generally similar tensions.

9. The integrally-harmonic stringed musical instrument of claim 8, further comprising:

said first and second string tuned relatively to each other in a fifth.

10. A bridge for a stringed musical instrument, comprising:

a base plate connectable to the stringed instrument;

an upstanding flange coupled to said base plate;

a first bolt or screw passing through said upstanding flange; and a first saddle, said first saddle defining a first groove, said first saddle adjustably threaded upon said first bolt or screw and creating a stop for a first string passing over said first saddle; whereby said first string of the stringed musical instrument may pass over said first grooved saddle and be supported thereby offset from the stringed musical instrument, said first bolt or screw adjustably tensioning said first string by adjustably positioning said first saddle.

11. The bridge for a stringed musical instrument according to claim 10, further comprising:

said upstanding flange defining a crenel, said crenel aligned with said first groove; whereby said first string of the stringed musical instrument may pass over said first saddle retained in said first groove and through said crenel of said upstanding flange.

12. The bridge for a stringed musical instrument according to claim 10, further comprising:

said base plate defining a hole, said hole aligned with said first groove; whereby said first string of the stringed musical instrument may pass over said first saddle retained in said first groove and through said hole of said base plate.

13. The bridge for a stringed musical instrument according to claim 10, further comprising:

a second saddle, said second saddle defining a second groove, said second saddle adjustably threaded upon a second bolt or screw and creating a stop for a second string passing over said second saddle, said second saddle adjacent said first saddle; whereby said first and second saddles serve to stably hold said first and second strings apart a fixed distance according to widths of said first and second saddles.

14. The bridge for a stringed musical instrument according to claim 13, further comprising:

said first and second saddles being generally cylindrical.

15. The bridge for a stringed musical instrument according to claim 13, further comprising:

said first and second saddles being generally rectangular.

16. The bridge for a stringed musical instrument according to claim 15, further comprising:

said first and second saddles being generally square; and said first and second grooves being angled downwardly toward said base plate.

17. The bridge for a stringed musical instrument according to claim 13, further comprising:

said first saddle being 25/32 inches wide;

said second saddle being 25/32 inches wide;

a third saddle, said third saddle adjacent said second saddle, said third saddle being $^{23}/_{32}$ inches wide;

a fourth saddle, said fourth saddle being adjacent said third saddle, said fourth saddle being $^{24}/_{32}$ inches wide; and a fifth saddle, said fifth saddle being adjacent said fourth saddle, said fifth saddle being $^{23}/_{32}$ inches wide; whereby said first and second saddles define a first interstring distance of $^{25}/_{32}$ inches, said second and third saddles define a second interstring distance of $^{24}/_{32}$ inches, said third and fourth saddles define a third interstring distance of $^{23.5}/_{32}$ inches, and said fourth and fifth saddles define a fourth interstring distance of 23.5 32 inches.

18. A string retainer for a stringed musical instrument, comprising:

a body, said body defining an aperture having a sloped roof, said aperture sized to control and adjust tension on a string of the stringed musical instrument.

19. A method for tuning a stringed instrument, the steps comprising:

providing first and second strings;

tuning said second string to a fifth above said first string; whereby playing said first string causes said second string to vibrate in a manner harmonious with said first string as said second string is a fifth above said first string.

20. The method for tuning a stringed instrument as set forth in claim 19, the steps further comprising:

providing third, fourth, and fifth strings;

tuning said third string to a fifth above said second string;

tuning said fourth string to a fifth above said third string; and tuning said fifth string to a fifth above said fourth string; whereby sympathetic vibrations of one of said five strings arising in response to the playing of another one of said five strings are harmonious with the note of said played string.

* * * * *

UNITED STATES PATENT AND TRADEMARK OFFICE

CERTIFICATE OF CORRECTION

PATENT NO. : 6,426,454 B1 
DATED : July 30, 2002
INVENTOR(S) : Maestro Alex Gregory It is certified that error appears in the above-identified patent and that said Letters Patent is hereby corrected as shown below:

Column 12,
Line 36, "F#b/F" should be -- F#b/F# --.
Line 53, "D/D" should be -- Db/D --.

Signed and Sealed this

Twenty-sixth Day of August, 2003

JAMES E. ROGAN
*Director of the United States Patent and Trademark Office*